US011124348B2

(12) United States Patent
McDonald et al.

(10) Patent No.: US 11,124,348 B2
(45) Date of Patent: Sep. 21, 2021

(54) HEAT SEALED PACKAGING ASSEMBLIES AND METHODS OF PRODUCING AND USING THE SAME

(71) Applicants: John McDonald, Fallbrook, CA (US); Frank Comerford, Laguna Niguel, CA (US); Myles Comerford, Rancho Santa Fe, CA (US)

(72) Inventors: John McDonald, Fallbrook, CA (US); Frank Comerford, Laguna Niguel, CA (US); Myles Comerford, Rancho Santa Fe, CA (US)

( * ) Notice: Subject to any disclaimer, the term of this patent is extended or adjusted under 35 U.S.C. 154(b) by 301 days.

(21) Appl. No.: 15/706,594

(22) Filed: Sep. 15, 2017

(65) Prior Publication Data

US 2018/0002095 A1 Jan. 4, 2018

Related U.S. Application Data

(63) Continuation of application No. 14/222,410, filed on Mar. 21, 2014, now abandoned.

(51) Int. Cl.
*B65D 81/07* (2006.01)
*B65D 5/50* (2006.01)

(52) U.S. Cl.
CPC ..... *B65D 81/075* (2013.01); *B65D 5/5028* (2013.01)

(58) Field of Classification Search
CPC ..... B31B 50/26; B31B 50/732; B31B 50/88; B31B 2105/0024; B65D 81/075; B65D 5/5028; B65B 23/00; B65B 53/00
USPC ..... 493/59, 68, 70, 79, 81; 53/472, 441; 206/583
See application file for complete search history.

(56) References Cited

U.S. PATENT DOCUMENTS

| | | | |
|---|---|---|---|
| 1,821,692 | A | 9/1931 | Copeland |
| 2,012,131 | A | 8/1935 | Kondolf |
| 2,161,128 | A | 6/1939 | Boyle |
| 2,746,665 | A | 4/1950 | Wiggins |
| 2,617,573 | A | 11/1952 | Nahoom |
| 2,723,796 | A | 11/1955 | Malmgren |
| 2,797,855 | A | 7/1957 | Moore |

(Continued)

FOREIGN PATENT DOCUMENTS

| | | |
|---|---|---|
| CA | 2 776 889 | 5/2011 |
| DE | 299 21 203 | 2/2000 |

(Continued)

OTHER PUBLICATIONS

GXT Green, "ECO-R$^3$SP Reusable Suspension Packaging", http://web.archive.org/web/20160425174511/http://www.gxtgreen.com/r3sp as archived Apr. 25, 2016, in 3 pages.

(Continued)

*Primary Examiner* — Anna K Kinsaul
*Assistant Examiner* — Veronica Martin
(74) *Attorney, Agent, or Firm* — Knobbe, Martens, Olson & Bear, LLP

(57) ABSTRACT

A packaging device can include a resilient member formed of one or more layers of different materials and a frame member. The resilient member can be heat sealed to the frame member or to a coating on the surface of the frame member. The layers can be made from different materials or the same materials having different thicknesses, modules of elasticity, melting index, or other different characteristics.

6 Claims, 20 Drawing Sheets

(56) References Cited

U.S. PATENT DOCUMENTS 2,807,265 A 9/1957 Oliva et al.
2,948,455 A 8/1960 Frankenstein
2,956,672 A 10/1960 Kirkpatrick
3,047,137 A 7/1962 Kindseth
3,089,631 A 5/1963 Tyrseck et al.
3,285,493 A 11/1966 Coe et al.
3,326,410 A 6/1967 Asenbauer
3,345,643 A 10/1967 Bradley
3,434,650 A 3/1969 Goings
3,438,562 A 4/1969 Connor et al.
3,502,488 A 3/1970 Bridgford
3,695,421 A 10/1972 Wood
3,706,174 A 12/1972 Young et al.
3,853,220 A 12/1974 Luray
3,854,650 A 12/1974 Hanaue
3,899,119 A 8/1975 Roccaforte
3,905,474 A 9/1975 Haibara
3,917,108 A 11/1975 Thurman
3,923,578 A 12/1975 Hair
3,994,433 A 11/1976 Jenkins et al.
4,014,292 A 3/1977 Coughlin et al.
4,034,908 A 7/1977 Forbes et al.
4,077,518 A 3/1978 Kisslinger et al.
4,155,453 A 5/1979 Ono
4,212,703 A 7/1980 D'Amico et al.
4,272,009 A 6/1981 Bamburg et al.
4,335,817 A 6/1982 Bahr
4,379,008 A 4/1983 Gross et al.
4,606,460 A 8/1986 Luray
4,698,246 A 10/1987 Gibbons et al.
4,801,774 A 1/1989 Hart
4,806,398 A 2/1989 Martin, Jr.
4,830,272 A 5/1989 Wear et al.
4,852,743 A 8/1989 Ridgeway
4,886,299 A 12/1989 Ducorday
4,923,065 A 5/1990 Ridgeway
5,024,536 A 6/1991 Hill
5,029,900 A 7/1991 Axelrod
5,046,659 A 9/1991 Warburton
5,050,766 A 9/1991 Groh
5,056,665 A 10/1991 Boecker et al.
5,071,009 A 12/1991 Ridgeway
5,076,436 A 12/1991 Bortolani et al.
5,080,497 A 1/1992 Peppiatt
5,183,159 A 2/1993 Hojnacki et al.
5,207,327 A 5/1993 Brondos
5,211,290 A 5/1993 Janus et al.
5,217,159 A 6/1993 Calvert et al.
5,218,510 A 6/1993 Bradford
5,223,121 A 6/1993 Dickie et al.
5,226,542 A 7/1993 Boecker et al.
5,226,734 A 7/1993 Scott et al.
5,251,760 A 10/1993 Smith et al.
5,301,872 A 4/1994 Tusing et al.
5,318,219 A 6/1994 Smith
5,322,168 A 6/1994 Kataoka
5,323,896 A 6/1994 Jones
5,356,007 A 10/1994 Feldt
5,372,257 A 12/1994 Beauchamp et al.
5,388,701 A 2/1995 Ridgeway
5,394,985 A 3/1995 Van Hest
5,405,000 A 4/1995 Hagedon et al.
5,467,916 A 11/1995 Beales
5,474,230 A 12/1995 Yotukura
5,492,223 A 2/1996 Boardman et al.
5,524,789 A 6/1996 Jackman
5,562,228 A 10/1996 Ericson
5,579,917 A 12/1996 Lofgren et al.
5,641,068 A 6/1997 Warner
5,669,506 A 9/1997 Lofgren et al.
5,676,245 A 10/1997 Jones
5,678,695 A 10/1997 Ridgeway
5,694,744 A 12/1997 Jones
5,722,541 A 3/1998 Lofgren et al.
5,731,021 A 3/1998 Spector
5,738,218 A 4/1998 Gonzales
5,762,200 A 6/1998 Goudreau
5,769,235 A 6/1998 Keach et al.
5,788,081 A 8/1998 Bates et al.
5,797,493 A 8/1998 Watson
5,803,267 A 9/1998 Tu et al.
5,823,348 A 10/1998 Phillips et al.
5,823,352 A 10/1998 Mena et al.
5,893,462 A 4/1999 Ridgeway
5,894,932 A 4/1999 Harding et al.
5,934,473 A 8/1999 Belshé
5,934,474 A 8/1999 Renninger et al.
5,954,203 A 9/1999 Marconi
5,967,327 A 10/1999 Jones
RE36,412 E 11/1999 Jones
5,975,307 A 11/1999 Harding et al.
5,988,387 A 11/1999 Staal et al.
6,006,917 A 12/1999 Loeffler
6,010,003 A 1/2000 Wilkinson
6,047,831 A 4/2000 Jones
6,073,761 A 6/2000 Jones
6,079,563 A 6/2000 Katchmazenski
6,116,501 A 9/2000 Hupp
6,119,863 A 9/2000 Lofgren et al.
6,119,929 A 9/2000 Rose
6,148,590 A 11/2000 Ridgeway et al.
6,148,591 A 11/2000 Ridgeway et al.
6,158,589 A 12/2000 Smith et al.
6,164,821 A 12/2000 Randall
6,206,194 B1 3/2001 Beneroff et al.
6,223,901 B1 5/2001 Lofgren et al.
6,244,441 B1 6/2001 Ahlgren
6,289,655 B1 9/2001 Ridgeway et al.
6,302,274 B1 10/2001 Ridgeway
6,308,828 B1 10/2001 Jones
6,311,843 B1 11/2001 Smith et al.
6,311,844 B1 11/2001 Ridgeway et al.
6,325,239 B2 12/2001 Randall et al.
6,364,199 B1 4/2002 Rose
6,394,336 B1 5/2002 Beneroff et al.
6,398,412 B2 6/2002 Wedi et al.
6,467,624 B1 10/2002 Lofgren et al.
6,488,153 B1 12/2002 Morris
6,675,973 B1 1/2004 McDonald et al.
6,676,009 B1 1/2004 Rose
6,676,293 B2 1/2004 Ferris
6,837,420 B2 1/2005 Westerman et al.
6,899,229 B2 5/2005 Dennison et al.
6,913,147 B2 7/2005 Mueller et al.
6,920,981 B2 7/2005 Lofgren et al.
6,942,101 B2 9/2005 Lofgren et al.
7,000,774 B2 2/2006 Bryant
7,086,534 B2 8/2006 Roesel et al.
7,096,647 B2 8/2006 De Barbuat et al.
7,114,618 B2 10/2006 Arnold
7,124,555 B2 10/2006 Torre
7,140,773 B2 11/2006 Becker et al.
7,150,356 B2 12/2006 Lofgren et al.
7,192,640 B2 3/2007 Holbert et al.
7,255,261 B2 8/2007 Mesly
7,290,662 B2 11/2007 Lofgren et al.
7,293,695 B2 11/2007 Stier
7,296,681 B2 11/2007 McDonald et al.
7,299,926 B2 11/2007 Russel et al.
7,398,884 B2 7/2008 Stegner et al.
7,452,316 B2 11/2008 Cals et al.
7,478,514 B2 1/2009 Wenz
7,654,391 B2 2/2010 Langer et al.
7,669,716 B2 3/2010 Lightner et al.
7,673,751 B2 3/2010 Keiger
7,694,496 B2 4/2010 Keiger et al.
7,731,032 B2 6/2010 McDonald et al.
7,743,924 B2 6/2010 McDonald et al.
7,753,209 B2 7/2010 McDonald et al.
7,770,734 B2 8/2010 Saitou et al.
7,775,367 B2 8/2010 McDonald et al.
7,784,614 B2 8/2010 Yen
7,882,956 B2 2/2011 McDonald et al.
7,918,339 B2 4/2011 Kashiwabara

(56) References Cited

U.S. PATENT DOCUMENTS

| | | | | |
|---|---|---|---|---|
| 7,931,151 | B2 | 4/2011 | McDonald et al. | |
| 8,016,112 | B2 | 9/2011 | Kasiwabara | |
| 8,028,838 | B2 | 10/2011 | McDonald et al. | |
| 8,123,039 | B2 | 2/2012 | McDonald et al. | |
| 8,127,928 | B2 | 3/2012 | Stack, Jr. et al. | |
| 8,177,067 | B2 | 5/2012 | McDonald et al. | |
| 8,181,787 | B2 | 5/2012 | Klos | |
| 8,215,488 | B2 | 7/2012 | Klos | |
| 8,235,216 | B2 | 8/2012 | McDonald et al. | |
| 8,316,760 | B2 | 11/2012 | Berthault | |
| 8,408,412 | B2 | 4/2013 | Hong | |
| 8,499,937 | B2 | 8/2013 | McDonald et al. | |
| 8,505,731 | B2 | 8/2013 | McDonald et al. | |
| 8,579,184 | B2 | 11/2013 | Pettersson et al. | |
| 8,627,958 | B2 | 1/2014 | McDonald et al. | |
| 8,714,357 | B2 | 5/2014 | Ridgeway | |
| 8,727,123 | B1 | 5/2014 | Roberts | |
| 8,752,707 | B2 | 6/2014 | McDonald et al. | |
| 8,783,459 | B1 | 7/2014 | Marcinkowski | |
| 9,067,722 | B2 | 6/2015 | McDonald et al. | |
| 9,126,743 | B2 | 9/2015 | Roberts | |
| 9,150,343 | B2 | 10/2015 | Roberts | |
| 9,199,761 | B2 | 12/2015 | McDonald et al. | |
| 9,463,915 | B2 | 10/2016 | McDonald et al. | |
| 10,315,829 | B2 | 6/2019 | McDonald et al. | |
| 2001/0047950 | A1 | 12/2001 | Beneroff et al. | |
| 2003/0034273 | A1 | 2/2003 | Auclair | |
| 2003/0116468 | A1 | 6/2003 | Schwester | |
| 2003/0209463 | A1 | 11/2003 | Halpin | |
| 2003/0213717 | A1 | 11/2003 | Kanai | |
| 2003/0234207 | A1 | 12/2003 | Koike | |
| 2004/0086692 | A1 | 5/2004 | Clark | |
| 2004/0108239 | A1 | 6/2004 | McDonald et al. | |
| 2004/0129601 | A1 | 7/2004 | Lofgren et al. | |
| 2004/0140243 | A1 | 7/2004 | Roesel et al. | |
| 2004/0178113 | A1 | 9/2004 | Lofgren et al. | |
| 2005/0011807 | A1 | 1/2005 | Dennison et al. | |
| 2005/0121354 | A1 | 6/2005 | Gillis et al. | |
| 2005/0252825 | A1 | 11/2005 | Lofgren et al. | |
| 2005/0286816 | A1 | 12/2005 | Laske | |
| 2006/0000743 | A1 | 1/2006 | Lofgren et al. | |
| 2006/0032777 | A1 | 2/2006 | Russell et al. | |
| 2006/0042995 | A1 | 3/2006 | McGrath et al. | |
| 2006/0102515 | A1 | 5/2006 | McDonald et al. | |
| 2006/0213803 | A1 | 9/2006 | Saitou et al. | |
| 2006/0285777 | A1 | 12/2006 | Howell et al. | |
| 2007/0237863 | A1 | 10/2007 | Langen | |
| 2007/0284281 | A1 | 12/2007 | Shimazu et al. | |
| 2008/0110788 | A1* | 5/2008 | Keiger | B65D 5/5028 206/497 |
| 2008/0110794 | A1 | 5/2008 | Anderson et al. | |
| 2008/0223750 | A1 | 9/2008 | McDonald et al. | |
| 2008/0230592 | A1 | 9/2008 | Cavell et al. | |
| 2009/0188833 | A1 | 7/2009 | Klos | |
| 2009/0242448 | A1 | 10/2009 | Keiger | |
| 2009/0308880 | A1 | 12/2009 | Sims et al. | |
| 2010/0001056 | A1 | 1/2010 | Chandaria | |
| 2010/0192519 | A1 | 8/2010 | Keiger | |
| 2010/0200453 | A1 | 8/2010 | Keiger | |
| 2010/0276330 | A1 | 11/2010 | McDonald et al. | |
| 2010/0307111 | A1 | 12/2010 | McDonald et al. | |
| 2011/0068042 | A1 | 3/2011 | Palumbo | |
| 2011/0095076 | A1 | 4/2011 | Knighton | |
| 2011/0108448 | A1 | 5/2011 | Goodrich | |
| 2011/0139673 | A1 | 6/2011 | Klos | |
| 2011/0240515 | A1* | 10/2011 | Ridgeway | B65D 5/5028 206/583 |
| 2012/0043252 | A1 | 2/2012 | McDonald et al. | |
| 2012/0045558 | A1 | 2/2012 | Fanfani et al. | |
| 2012/0125807 | A1 | 5/2012 | Jones et al. | |
| 2012/0181213 | A1 | 7/2012 | Klos | |
| 2012/0193263 | A1 | 8/2012 | Takahashi | |
| 2012/0193405 | A1 | 8/2012 | McDonald et al. | |
| 2012/0211388 | A1 | 8/2012 | Orgeldinger | |
| 2012/0234723 | A1 | 9/2012 | Klos | |
| 2012/0241336 | A1* | 9/2012 | Finley | B65D 81/3233 206/219 |
| 2012/0272620 | A1* | 11/2012 | McDonald | B65D 5/5028 53/441 |
| 2013/0043298 | A1 | 2/2013 | Takahashi | |
| 2013/0048533 | A1 | 2/2013 | McDonald et al. | |
| 2013/0091807 | A1 | 4/2013 | McDonald et al. | |
| 2013/0137562 | A1 | 5/2013 | Penttinen et al. | |
| 2013/0233752 | A1 | 9/2013 | Hammerschmidt | |
| 2013/0284733 | A1 | 10/2013 | Samprathi | |
| 2014/0076769 | A1 | 3/2014 | McDonald et al. | |
| 2014/0123599 | A1* | 5/2014 | Gustafsson | B65B 9/067 53/405 |
| 2014/0183097 | A1 | 7/2014 | Leroy et al. | |
| 2014/0284248 | A1 | 9/2014 | Klos | |
| 2014/0360913 | A1 | 12/2014 | McDonald et al. | |
| 2015/0114875 | A1 | 4/2015 | McDonald et al. | |
| 2015/0114876 | A1 | 4/2015 | McDonald et al. | |
| 2015/0239635 | A1 | 8/2015 | McDonald et al. | |
| 2015/0266639 | A1 | 9/2015 | McDonald et al. | |
| 2015/0266642 | A1 | 9/2015 | McDonald et al. | |
| 2015/0314936 | A1 | 11/2015 | Stack, Jr. et al. | |
| 2016/0016685 | A1 | 1/2016 | Bauernfeind | |
| 2016/0159550 | A1 | 6/2016 | McDonald et al. | |
| 2018/0208350 | A1 | 7/2018 | Ertmer | |
| 2018/0244424 | A1 | 8/2018 | Perella et al. | |
| 2018/0290787 | A1 | 10/2018 | McDonald et al. | |

FOREIGN PATENT DOCUMENTS

| | | |
|---|---|---|
| DE | 101 05 487 | 8/2002 |
| DE | 202 17 626 | 1/2003 |
| EP | 0 980 334 | 8/2002 |
| EP | 1 431 196 | 6/2004 |
| EP | 1 561 693 | 8/2005 |
| EP | 1 657 166 | 5/2006 |
| EP | 1 657 167 | 5/2006 |
| EP | 2 546 170 | 1/2013 |
| JP | 05-305956 | 11/1993 |
| JP | 2004-231228 | 8/2004 |
| JP | 2005-146112 | 6/2005 |
| SU | 827346 A1 | 5/1981 |
| WO | WO 00/053499 | 9/2000 |
| WO | WO 00/064772 | 11/2000 |
| WO | WO 2006/081360 | 8/2006 |
| WO | WO 2007/127243 | 11/2007 |
| WO | WO 2008/070734 | 6/2008 |
| WO | WO 2008/115829 | 9/2008 |
| WO | WO 2013/150312 | 10/2013 |
| WO | WO 2014/043569 | 3/2014 |
| WO | WO 2015/143175 | 9/2015 |

OTHER PUBLICATIONS

High-Tech Information Service Co., "Introduction of Packing Material 'High-Tech Cushion'", http://www.his-net.jp/ as printed Apr. 26, 2016 in 2 pages.

HiTec Cushion, http://hitec-cushion.his-net.jp/ as printed Apr. 26, 2016 in 2 pages.

HiTec Cushion, http://web.archive.org/web/20140301081401/http:/hitec-cushion.his-net.jp/ as archived Mar. 1, 2014 in 2 pages.

HiTec Cushion, "Base", https://web.archive.org/web/20130926211952/http:/hitec-cushion.his-net.jp/base/index.html as archived Sep. 26, 2013 in 1 page.

HiTec Cushion, "Eco", http://hitec-cushion.his-net.jp/base/eco.html as printed Apr. 26, 2016 in 1 page.

HiTec Cushion, "Eco", https://web.archive.org/web/20090714064204/http:/hitec-cushion.his-net.jp/base/eco.html as archived Jul. 14, 2009 in 1 page.

HiTec Cushion, "Product List", http://hitec-cushion.his-net.jp/main/itiranu.html as printed Apr. 26, 2016 in 6 pages.

HiTec Cushion, "Introduction of Packing Material", http://hitec-cushion.his-net.jp/main/standard.html as printed Apr. 26, 2016 in 3 pages.

International Search Report & Written Opinion in PCT Application No. PCT/US2015/021497, dated Jun. 22, 2015.

(56) References Cited

OTHER PUBLICATIONS

International Preliminary Report & Written Opinion in PCT Application No. PCT/US2015/021497, dated Sep. 29, 2016.
Japan Packaging Institute (JPI), "Accessories for Packing, 'High-Tech Cushion'", http://www.jpi.or.jp/saiji/jpc/2007/japanese/026.htm as printed Apr. 26, 2016 in 1 page.
Resende, Patricia, "Startup to Bring Photo-Degradable Bags to Grocery Chains", http://www.bizjournals.com/boston/blog/mass-high-tech/2012/04/startup-to-bring-photo-degradable-bags.html, Apr. 12, 2012, pp. 2.

* cited by examiner

HEAT SEALED PACKAGING ASSEMBLIES AND METHODS OF PRODUCING AND USING THE SAME

BACKGROUND OF THE INVENTIONS

Field of the Inventions

The present inventions are directed to a package assembly. In particular, the present inventions are directed to a package assembly that includes a stretchable resilient member connected to a frame member.

Description of the Related Art

Protective packaging devices are often used to protect goods from shocks and impacts during shipping or transportation. For example, when transporting articles that are relatively fragile, it is often desirable to cushion the article inside a box to protect the article from a physical impact with the inner walls of the box that might be caused by shocks imparted to the box during loading, transit, and/or unloading.

In most cases, some additional structure is used to keep the article from moving uncontrollably within the box. Such additional structures include paper or plastic packing material, structured plastic foams, foam-filled cushions, and the like. Ideally, the article to be packaged is suspended within the box so as to be spaced from at least some of the walls of the box, thus protecting the article from other foreign objects which may impact or compromise the outer walls of the box.

U.S. Pat. No. 6,675,973 discloses a number of inventions directed to suspension packaging assemblies which incorporate frame members and one or more retention members. For example, many of the embodiments of the U.S. Pat. No. 6,675,973 patent include the use of a retention member formed of a resilient material. Additionally, some of the retention members include pockets at opposite ends thereof.

In several of the embodiments disclosed in the U.S. Pat. No. 6,675,973 patent, free ends of the frame members are inserted into the pockets of the retention member. The free ends of the frame member are then bent, pivoted, or folded to generate the desired tension in the retention member. Because the retention member is made from a resilient material, the retention member can stretch and thus provide a mechanism for suspending an article to be packaged, for example, within a box.

SUMMARY OF THE INVENTIONS

An aspect of at least one of the embodiments disclosed herein includes the realization that packaging devices that are designed to retain items to be packaged using a thin stretchable film can be further improved by heat sealing the thin stretchable film to a frame member of the package device. As such, the resulting packaging devices with a thin resilient member attached thereto can be manufactured using high speed, automated manufacturing processes, thus increasing the total number of packaging devices prepared within a certain period of time. Moreover, use of heat sealing can further reduce the total size of the thin resilient member used by 20% to 30% depending on the method of attachment for the thin resilient member.

For example, in some embodiments, the resilient member can be heat sealed to a frame member with the resilient member disposed over a central portion of the frame member. The resilient member can be a thin resilient sheet and the frame member can be formed from corrugated material. The resilient member can be heat sealed to one or more rotatable portions of the frame member and sized such that, when the rotatable portions are rotated relative to the central portion, the resilient member can be stretched and thus aid in forming shock absorbing packaging for an article.

Heat sealing of the resilient member to the frame member can be achieved with a variety of different heat sealing techniques, for example, by heat sealing the resilient member directly to a surface of the frame member, by heat sealing the resilient member to a coating placed over a surface of the frame member, or a combination of both.

In some embodiments, in order to allow the resilient member to be stretched or tensioned, less than all of the resilient member is heat sealed to the frame member. In some embodiments, only about 10% or less of the resilient member is heat sealed. As should be understood, the frame member can have a variety of different shapes, wall portions, and apertures depending on the nature of the item to be packaged, the desired packaging method (e.g., suspension or retention), the container in which the frame member is placed, and a variety of other factors.

In some embodiments, the resilient member can be formed with two layers of different material, heat sealed to one another, and optionally, heat sealed to the frame member. In some cases, the two different materials can be different kinds of material, different thicknesses of the same material, different grades of translucency (e.g., one layer being opaque and one layer being transparent), different modules of elasticity or other different characteristics. When using heat sealing to attach the layers to one another, different materials having melt index values over a large range of such values can be used. For example, with regard to some materials, different layers made from different materials can be heat sealed together using high speed manufacturing equipment. Such high speed heat sealing is achieved more easily when the melt index of these materials falls approximately within the range of 7.0 to 10.0. However, other materials and other attachment techniques can also be used.

Thus, in accordance with an embodiment, a suspension packaging assembly can comprise at least one frame member having a central portion, a first end and a second end disposed opposite the first end relative to the central portion, a first foldable portion disposed at the first end and a second foldable portion disposed at the second end. Additionally, a resilient member can comprise a first layer having first and second longitudinal ends and first and second lateral edges and a second layer having first and second longitudinal ends and first and second lateral edges, the first layer being heat sealed to the second layer along the corresponding first and second lateral edges.

In accordance with another embodiment, a resilient member for providing damage protection for packaged goods can comprise a first layer having first and second longitudinal ends and first and second lateral edges. A second layer can include first and second longitudinal ends and first and second lateral edges, where the first layer is heat sealed to the second layer along the corresponding first and second lateral edges.

All of these embodiments are intended to be within the scope of at least one of the inventions disclosed herein. These and other embodiments of the inventions will become readily apparent to those skilled in the art from the following detailed description of the preferred embodiments having reference to the attached figures, the inventions not being limited to any particular preferred embodiment disclosed.

BRIEF DESCRIPTION OF THE DRAWINGS

These and other features of the inventions are described below with reference to the drawings of several embodiments of the present package assemblies and kits which are intended to illustrate, but not to limit, the inventions. The drawings contain the following figures.

DETAILED DESCRIPTION OF THE PREFERRED EMBODIMENTS

An improved packaging assembly is disclosed herein. The packaging assembly includes an improved structure which provides new alternatives to known suspension packaging systems.

In the following detailed description, terms of orientation such as "top", "bottom," "upper," "lower," "longitudinal," "horizontal," "vertical," "lateral," "midpoint," and "end" are used herein to simplify the description in the context of the illustrated embodiments. Because other orientations are possible, however, the present inventions should not be limited to the illustrated orientations.

Additionally, the terms "suspension" and "suspend" as used herein, are intended to refer to packaging configurations where an associated article is held in a position spaced from another member using a suspension technique, such as where an article is surrounded by stretchable films so as to be spaced away from rigid walls including walls of a container or box or walls of other rigid associated packaging members, devices, or mechanisms.

Further, the term "retention", as used herein, is intended to refer to packaging configurations wherein an associated article is held in the position pressed against another member, such as a frame member, a rigid member, or other packaging member, device, or mechanism, using techniques such as those including a stretchable, thin film pressing the article against the other member. Some of the embodiments of Packaging assembly is disclosed herein include aspects of both retention configurations and suspension configurations. Such embodiments might include, for example, stretchable, thin film material used to present article against a component made from rigid material but configured to be flexible and providing shock absorption. Such embodiments can be considered as a retention device and as a suspension device. Further, such embodiments can also be referred to as an "retention—suspension hybrid packaging configuration". Those skilled in the art will appreciate that other orientations of various components described herein are possible.

Figure 1A:
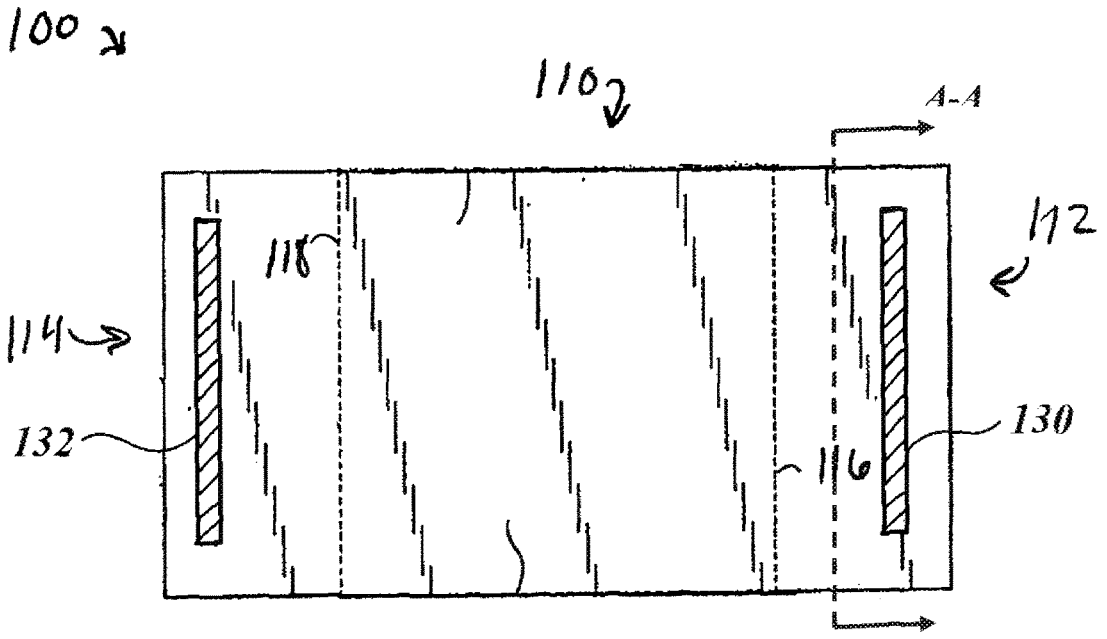
FIG. 1A is a plan view of a frame member having a central portion and two foldable portions disposed at opposite ends relative to the central portion.
Figure 2:
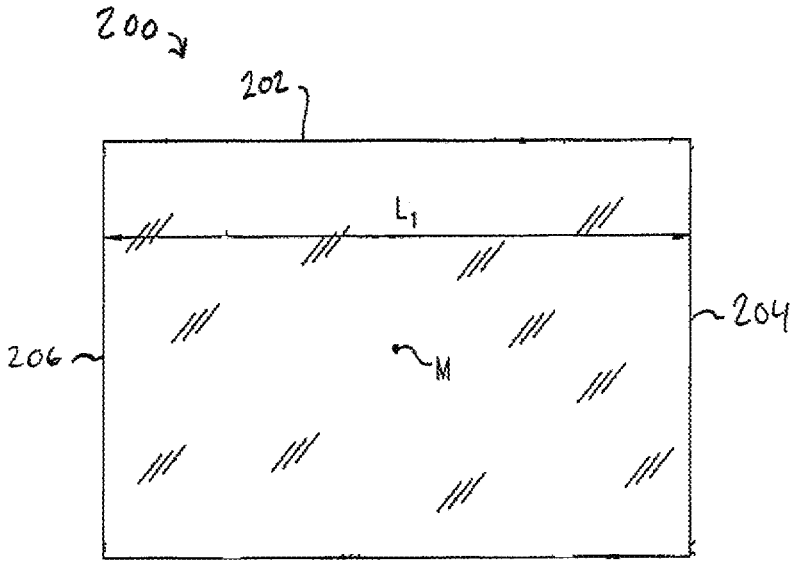
FIG. 2 is a plan view of a resilient member.

The packaging assemblies disclosed herein can include a frame member 100 (FIG. 1A) and a resilient member 200 (FIG. 2). The packaging assemblies and components disclosed herein are described in the context of retention packaging assemblies, such as packaging assemblies 140, 780, 1040 (FIGS. 3A, 16, 23), and suspension packaging assemblies, such as packaging assemblies 958, 1040 (FIGS. 20, 23), and retention-suspension hybrid packaging assemblies 1040 (FIG. 23) formed from a frame member and a resilient member, because they have particular utility in this context.

The inventions and embodiments disclosed herein are described in the context of suspension packaging assemblies, retention packaging assemblies, and hybrid suspension-retention packaging assemblies because they have particular utility in those contexts. However, the inventions disclosed herein can be used in other contexts as well.

With reference to FIG. 1A, the frame member 100 is illustrated in an unfolded state and is constructed in accordance with an embodiment. Generally, the frame member 100 includes a central portion 110 and a pair of opposing foldable portions 112, 114. The central member 110 can be configured to engage or provide support for one or more articles to be packaged.

In some embodiments, the foldable portions 112, 114 are configured to increase a tension in the resilient member 200 for holding one or more articles in a desired position relative to the central portion 110; an exemplary position being shown in FIGS. 3A-C and 4.

Figure 1B:
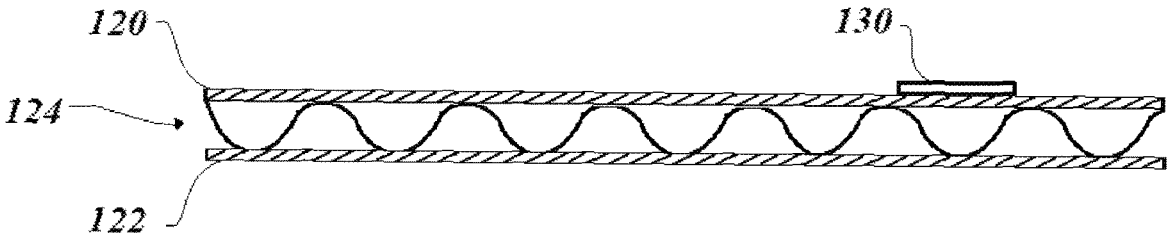
FIG. 1B is a cross-sectional view along line A-A of the frame member of FIG. 1A.

With reference to FIG. 1B, a cross-sectional view of the frame member 100 is shown which illustrates multiple layers of the frame member 100. In some embodiments, the frame member 100 can include outer layers, such as a top layer 120 and bottom layer 122, and an inner layer 124 between the outer layers. In some embodiments, the outer layers can have a smooth surface, a textured surface, or a combination of both. In some embodiments, the inner layer 124 can have a corrugated structure. As shown in the illustrated embodiment, the inner layer 124 can include a structure similar to those used for producing fluted cardboard such as, but not limited to, "A-Flute," "B-Flute," "C-Flute," "D-Flute, and "E-Flute" cardboard. Other types of corrugated structures used in cardboard packaging and similar devices can also be used. Moreover, combinations of cardboard layers can also be used. In some embodiments (not shown), the frame member 100 can include multiple inner layers. These multiple inner layers can be separated by an intermediate layer between each inner layer. The intermediate layer can have a similar structure as the outer layers, such as top layer 120 and bottom layer 122. In some embodiments, the intermediate layer can be composed of two outer layers bonded together. For example, one can take the structure shown in FIG. 11B and place it atop or below a similar structure to form a frame member having multiple inner layers.

The outer layers can be formed from fibrous materials such as paper-based and wood-based materials. This can include, for example, pulp, cardboard, cartonboard, paperboard, paper, chipboard and other such paper-based and wood-based materials known to those in the art. The outer layers can be formed from other materials such as plastics including high density polyethylene (HDPE), low density polyethylene (LDPE), polyvinyl chloride (PVC), nylon, composites such as fiberglass, metals, and any other such materials used by those in the art. The outer layers can be porous, including the fibrous materials and plastic materials described above, with the porosity chosen to enhance the heat seal between the frame member 100 and the resilient member 200. Heat sealing and the effect of porosity will be discussed in further detail below.

It should be appreciated that different materials can be used for different portions of the outer layers. For example, the top layer 120 and the bottom layer 122 can be formed from different materials. In some embodiments, particular portions of the top layer 120 and the bottom layer 122 can be formed from different materials. For example, the materials used for the foldable portions 112, 114 can be different from the materials used for the central member 100. By using different materials, it is possible to further enhance the performance of the frame member 100. For example, materials which are more suitable for heat sealing can be used along surfaces upon which a heat seal is to be formed whereas other types of materials can be used for the remaining surfaces.

The inner layer 124 can be formed from any of the materials as herein described as well as those used by those in the art. For example, the inner layer 124 can be formed from paper-based materials such as cardboard, paperboard, or paper. The chosen material for constructing the frame member 100 can be any substantially rigid, but foldable material. It will be appreciated that, although denominated as rigid or substantially rigid, the chosen material would preferably have an amount of flexibility in the cases of physical impact. The illustrated frame member 100 is a generally thin, planar member; however, the frame member 100 can have other configurations.

With continued reference to FIGS. 1A and 1B, in some embodiments, the frame member 100 can include one or more coating layers, such as coating layers 130, 132. These coating layers can be provided on one or more surfaces of the frame member 100 and can be placed at and/or proximate desired locations of the heat seals between the frame member 100 and the resilient member 200. As shown in the illustrated embodiment, coating layers 130, 132 can be provided on two separate sections of the upper layer 120.

These coatings can provide additional benefits when applied to the frame member 100. For example, coatings can include: ultraviolet (UV) coatings which assist with inhibiting deleterious effects of ultraviolet rays on the surface, aqueous coatings which can assist with inhibiting moisture from being absorbed into frame member 100, varnish coatings which can provide a sheen on the surface thus enhancing the appearance of the frame member 100, soft touch coatings which can provide a smooth or softer surface which can reduce the likelihood of damaging an article contacting the surface, and other types of coatings. Moreover, such coatings can also be beneficial in providing a surface to which a heat seal can be formed as will be described in further detail below. In this way, the coating layers can also be considered to work as a bonding layer. For example, such coatings can be formed from materials such as polyolefin, ethylene acrylic, polyurethane, low density polyethylene (LDPE), high density polyethylene (HDPE), and other types of polymers which can bond with the resilient member, such as resilient member 200. Other types of coatings include: polyamides, polyethylene terphthalates (PET), glycol-modified polyethylene terephthalate (PETG), polyvinylidene chlorides, polyvinyl chlorides, etc., and highly crystalline non-polar materials such as high-density polyethylene and polypropylene, ethylene-vinyl acetate (EVA), ethyl methyl acrylate (EMA), ionomers, acrylic polymers, acrylate copolymer, modifications of these compounds, and similar compounds. Such coatings can also include those produced by companies such as Endura Coatings, Michelman Inc., The Seydel Companies, Inc., Lubrizol Corporation, and other such companies.

As shown in FIGS. 1A and 1B, there are two coating layers 130, 132 along different portions of the top layer 120. Of course, a fewer or greater number of coating layers can be used and can be placed on the top layer 120, the bottom layer 122 or both layers. Moreover, the same or different types of coatings can be used for different coating layers and the coating layers can be stacked together. For example, a first coating layer can be placed over the top layer 120 and a second coating layer can be placed over the first coating layer. In some embodiments, the coating layers 130, 132 can have a length of 11 inches and a width of a half inch. However, as should be understood by one in the art after reading the remainder of this disclosure, the length and width can be adjusted depending on factors such as the materials used for the resilient member, the desired strength of the heat seal "hinge," and other such factors.

Such "localized application" of coating layers can be particularly advantageous in reducing the total amount of coating used for the frame member thus reducing material waste and reducing costs. For example, the coating layers can be placed along portions on which a heat seal will be formed. Such coating layers can also be placed proximate to portions on which a heat seal will be formed in order to account for slightly misplaced heat seals due to mechanical tolerances of the machinery used. In some embodiments, frame member 100 can be "flood coated" such that a coating layer is placed over a substantial portion, or the entirety of, the top layer 120, the bottom layer 122 or both. "Flood coating" can be preferable due to ease of application of the coating and/or if there is a benefit to adding the coating layer over the entire surface, such as the UV-coatings, aqueous coatings, varnish coatings, or soft-touch coatings as described above.

The central portion 110 can be sized and dimensioned so as to engage or provide support for one or more articles. Although the central portion 110 is described primarily as being disposed at the center of the frame member 100, the central portion 110 can be at other locations. Additionally, the central portion 110 can comprise a plurality of members, each configured to engage an article. For the sake of convenience, the central portion 110 is described as a generally planar centrally disposed member.

The size of the central portion 110, which defines a loading area, can be chosen arbitrarily or to accommodate, support, or engage an article of a particular size. The loading area size can be chosen based on the number and configuration of the articles on or proximate to the central portion 110. In some non-limiting exemplary embodiments, the central portion can be used to package one or more communication devices (e.g., portable phones, cellular phones, radios, headsets, microphones, etc.), electric devices and components, accessories (e.g., cellular phone covers), storage devices (e.g., disk drives), and the like. In certain embodiments, the central portion 110 is configured to package one more portable music players, such as IPODs® or MP3 players.

It is contemplated that the central portion 110 can be designed to package any number and type of articles. In the illustrated embodiment, the central portion 110 is somewhat square shaped and has a surface area (i.e., the loading area) of about 40-60 inches square. In some non-limiting embodiments, the central portion has a loading area more than about 40 inches square, 45 inches square, 50 inches square, 55 inches square, 60 inches square, and ranges encompassing such areas. However, these are merely exemplary embodiments, and the central portion 110 can have other dimensions for use in communication devices, packaging modems, hard drives, portable phones, or any other article that is to be packaged.

The illustrated central portion 110 has a generally flat upper surface that an article can rest against. Other non-limiting central portions can have mounting structures, apertures, recesses, partitions, separators, or other suitable structures for inhibiting movement of an article engaging the central portion or for providing additional shock protection. For example, the central portion 110 can have at least one holder that is sized and configured to receive an article.

Fold lines 116, 118 can be defined between the central portion 110 and the foldable portions 112, 114, respectively. The fold lines 116, 118 can be formed as perforations in the frame member 100, i.e., broken cut lines passing partially or completely through the material forming the frame member 100. In the alternative, or in addition, the fold lines 116, 118 can be crushed portions of the material forming the frame member 100. Of course, depending on the material used to construct the frame member 100, the fold lines 116, 118 can be formed as mechanical hinges, thinned portions, adhesive tape, or any other appropriate mechanical connection which would allow various portions of the foldable member to be folded or rotated with respect to each other. These concepts apply to all the fold lines 116, 118 described herein, although this description will not be repeated with respect to the other fold lines described below.

With such fold lines 116, 118, the foldable portions 112, 114 can be bent upwardly or downwardly relative to the central portion 110 as desired. With this flexibility, the foldable portions 112, 114 can be folded upwardly so as to create slack in the resilient member 200 to load an article to be packaged and folded downwardly to increase tension in the resilient member 200, described in greater detail below.

The illustrated configuration of the frame member 100 is merely one example of many different kinds and shapes of frame members that can be used. U.S. Pat. Nos. 6,675,973, 7,882,956, 7,296,681, 7,753,209, 8,028,838, 8,235,216, 8,627,958 and U.S. patent application Ser. No. 12/958,261 and Ser. No. 13/221,784, the contents of each of which is hereby incorporated by reference, all disclose various different kinds of frame members with various different combinations of additional folding portions which can be used as a substitute for the illustrated frame member 100. Certain of these embodiments are described in further detail below in connection with FIGS. 16-25; however, it should be understood that any other devices as described in the incorporated documents can also be modified in much the same manner.

Single Layer Resilient Member

With reference to FIG. 2, the resilient member 200 can be formed from a resilient sheet or film. As shown in the illustrated embodiment, the resilient member 200 can be formed from a single layer. The resilient member 200 is configured to engage and cooperate with the frame member 100. Optionally, the resilient member 200 can be configured to engage the foldable portions 112, 114 of the frame member 100 so as to, among other options, generate tension in the resilient member 200 when the foldable portions 112, 114 are folded relative to the central portion 110.

The resilient member 200 can be formed from a resilient body 202. For purposes of convenience for the following description, the body 202 is identified as having a midpoint M positioned in the vicinity of the middle of the resilient body 202. Resilient body 202 can also include ends 204, 206 disposed at opposite longitudinal and thereof.

The resilient member 200, in some embodiments, has a Length $L_1$ that is sized depending in the devices with which the resilient member 200 is to cooperate, such as goods. Thus, the Length $L_1$ can be sized such that when the resilient member 200 is in its final state, e.g., engaged with the foldable portions 112, 114, it generates the desired tension for the corresponding packaging application. Thus, the Length $L_1$ will be smaller where a higher tension is desired and will be larger where a lower tension is desired. Additionally, the Length $L_1$ might be different for different sized articles that are to be packaged. One of ordinary skill in the art can determine the Length $L_1$ for the corresponding application. Additionally, one of ordinary skill in the art is fully aware of how to perform industry standard drop tests to confirm the appropriate dimensioning of the frame member 100 and the resilient member 200.

The resilient member 200 can be formed of any resilient material. In some embodiments, the resilient member 200 can be formed of a layer of polyethylene films, low density polyethylene (LDPE), polyurethane, TPU, or virtually any polymer, or plastic film. The density of the layers of film can be varied to provide the desired retention characteristics such as overall strength, resiliency, and vibrational response. Preferably the density of the material used to form the resilient member 200 is determined such that the resilient member 200 is substantially resilient when used to package a desired article. The layer used to form resilient member 200 can be monolayer or multilayer sheet depending on the application.

Figure 3A:
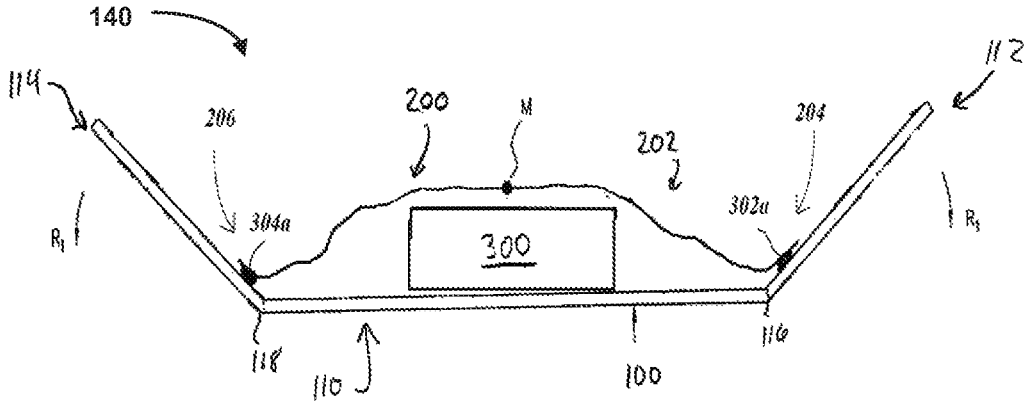
FIG. 3A is a schematic side elevational view of an assembly including the frame member of FIGS. 1A and 1B and the resilient member of FIG. 2 connected together with an article packaged therewith showing a first heat sealing location.
Figure 3B:
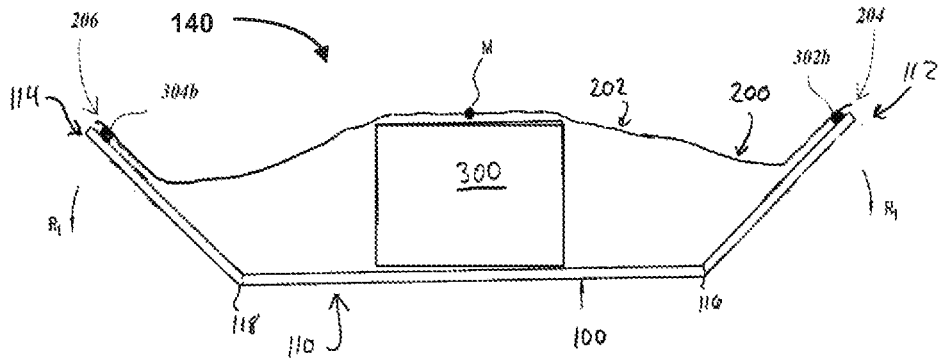
FIG. 3B is a schematic side elevational view of an assembly including the frame member of FIGS. 1A and 1B and the resilient member of FIG. 2 connected together with an article packaged therewith showing a second heat sealing location.
Figure 3C:
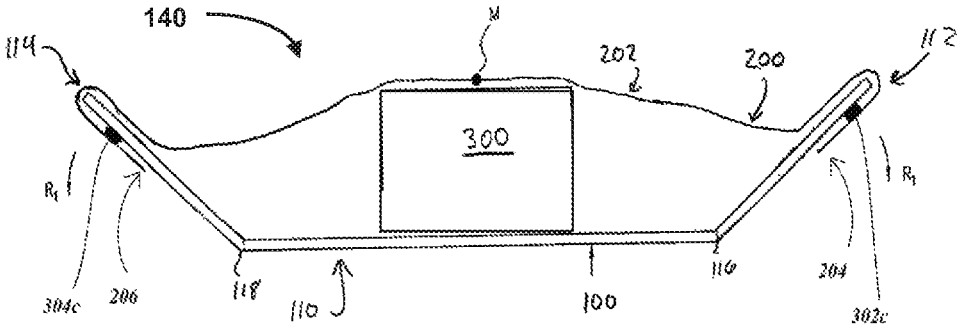
FIG. 3C is a schematic side elevational view of an assembly including the frame member of FIGS. 1A and 1B and the resilient member of FIG. 2 connected together with an article packaged therewith showing a third heat sealing location.

As illustrated in FIGS. 3A-3C, the frame member 100 can be used in conjunction with the resilient member 200 with the resilient member 200 being attached to the frame member 100 via heat seals 302*a-c*, 304*a-c*. The heat seals 302*a*, 304*a* can be formed on the upper or lower surfaces of the foldable portions 112, 114 proximal to or distal from the fold lines 116, 118. In some embodiments, as illustrated in FIG. 3A, the heat seals 302*a*, 304*a* can be formed on the upper surfaces of the foldable portions 112, 114 near the fold lines 116, 118. This location for the heat seal can be used, for example, when packaging articles which are comparatively smaller in area and/or height when compared to the loading area. Placement of the heat seals 302*a*, 304*a* at this location can result in use of a smaller resilient member 200 as can be seen in FIG. 3A.

As illustrated in FIG. 3B, the heat seals 302*b*, 304*b* can be formed on the upper surfaces of the foldable portions 112, 114 further from the fold lines 116, 118 and nearer the ends of the frame member 100. This location for the heat seal can be used, for example, when packaging articles which are mid-sized in comparison to the loading area. Placement of the heat seals 302*b*, 304*b* at this location can result in use of a slightly larger resilient member 200 as can be seen in FIG. 3B.

As illustrated in FIG. 3C, the heat seals 302*b*, 304*b* can be formed on bottom surfaces of the foldable portions 112, 114 further from the fold lines 116, 118 and nearer the ends of the frame member 100. This location for the heat seal can be used, for example, when packaging articles which are comparatively larger in area and/or height to the loading area. Placement of the heat seals 302*c*, 304*c* at this location can result in use of a larger resilient member 200 as can be seen in FIG. 3B. Accordingly, the length between the outer edges (i.e., the length of the packaging of the frame member 100) of the foldable portions 112, 114 can be slightly smaller or greater than the length $L_1$ of the resilient member 200 depending on multiple factors such as the size of the article to be packaged, the desired tension, and placement of the heat seals. The article to be packaged 300 can be inserted between the resilient member 200 and the frame member 100.

With reference now to FIGS. 3A-C and 4, with the article 300 disposed in the space between the resilient member 200 and the upper surface of the central portion 110, and with the foldable portions 112, 114, engaged with the ends 204, 206 via heat seals, the foldable portions 112, 114 can be rotated downwardly in the direction of arrows this initial movement from the position illustrated in FIGS. 3A-C, the foldable portions 112, 114 move away from the midpoint M of the resilient member 200, thereby creating tension in the resilient member 200.

As the foldable portions 112, 114 are further pivoted downwardly about the fold lines 116, 118, until they are doubled back adjacent to the lower surface of the central portion 110, the foldable portions 112, 114, continue to add additional tension into the resilient member 200. The frame member 100 and the resilient member 200 can be configured to form a spring when disposed in a box or container 310 in the arrangement shown in FIG. 4. For example, the frame member 100 itself can have some shape memory such that the fold lines 116, 118 provide some resistance to movement. Additionally, as noted above, the Length $L_1$ of the resilient member 200 can provide tension, resisting the further bending movement of the foldable portions 112, 114 about the fold lines 116, 118, respectively.

Figure 4:
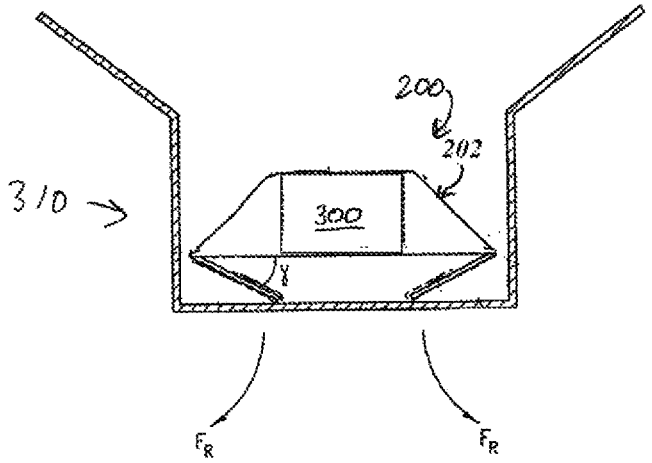
FIG. 4 is a schematic side elevational view of the assembly of FIG. 3C disposed inside a container.

Accordingly, when the frame member 100, resilient member 200, and the article 300 are arranged in the configuration shown in FIG. 4 inside the container 310, reaction Forces $F_r$ resist downward movement of the article 300, thereby providing additional cushioning for the article 300.

Further, the container 310 can define a maximum inner height, for example, when the lid portion of the container 310 is closed. With the maximum inner height set to a dimension less than the maximum overall height of the article 300 and frame member 100, the foldable portions 112, 114 are maintained such that the angular position $\gamma$ (FIG. 4) is maintained at an angle more acute that 90 degrees. Thus, the foldable portions are maintained in an orientation in which the frame member 100 and resilient member 200 work together to act as a shock absorbing spring for the article 300.

Figure 5:
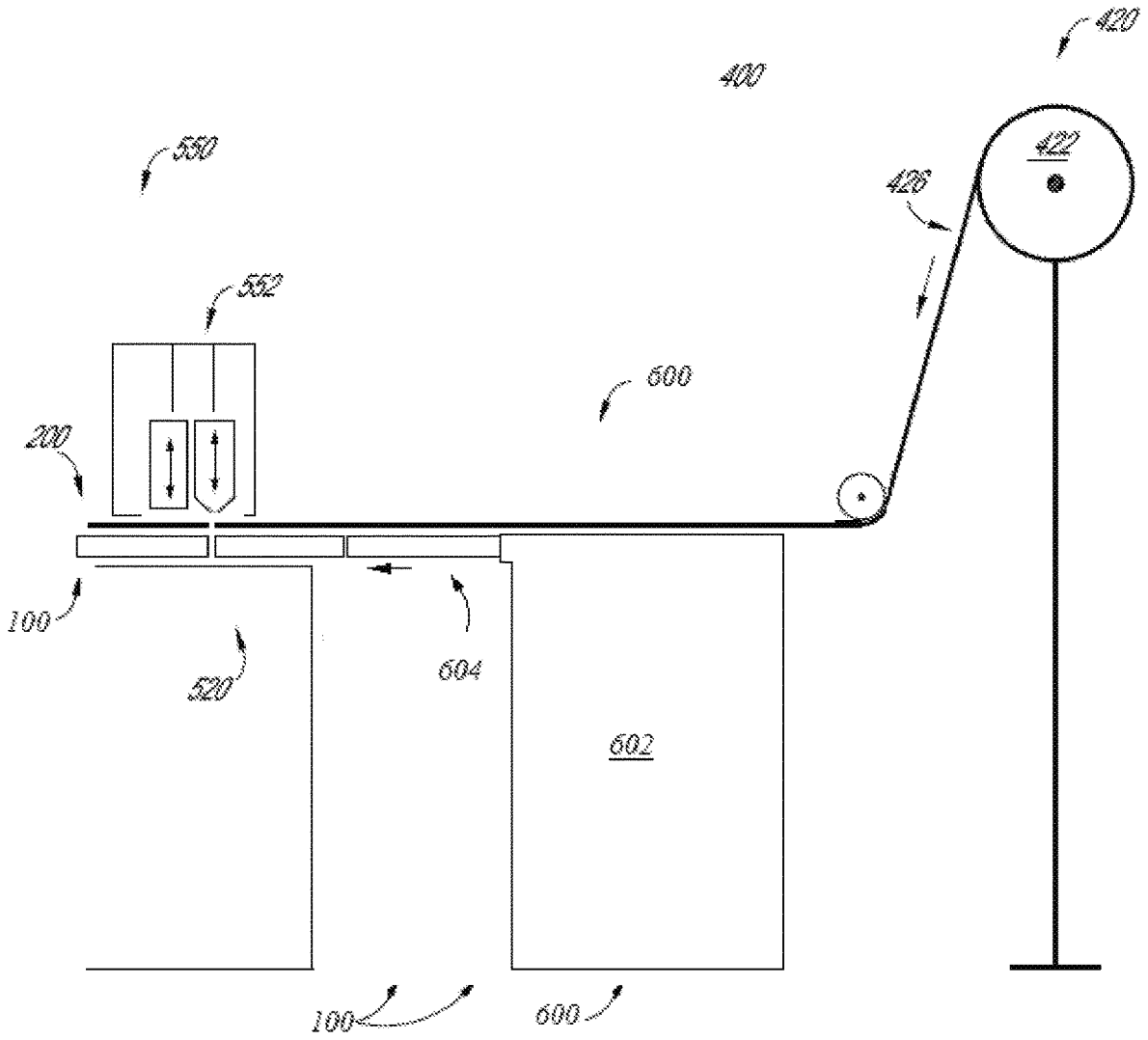
FIG. 5 is a schematic view of a manufacturing system that can be used to manufacture the frame member and resilient member assembly illustrated in FIGS. 3A-C.
Figure 6:
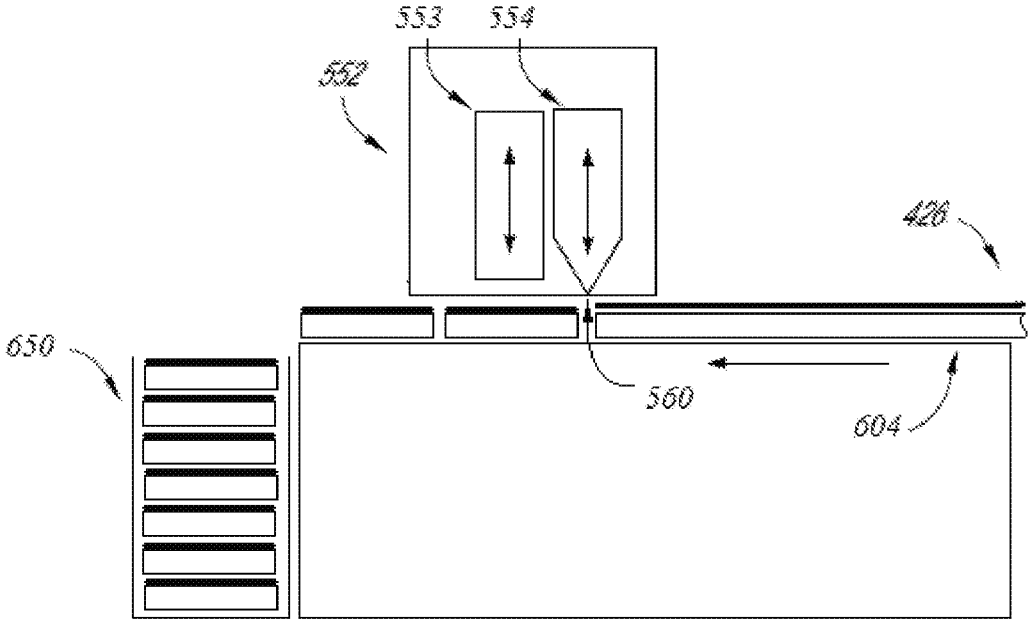
FIG. 6 is a schematic illustration of a heat sealing and cutting device of the system of FIG. 5 which heat seals and cuts apart frame members and resilient members from the continuous strips of FIG. 5.
Figure 6:
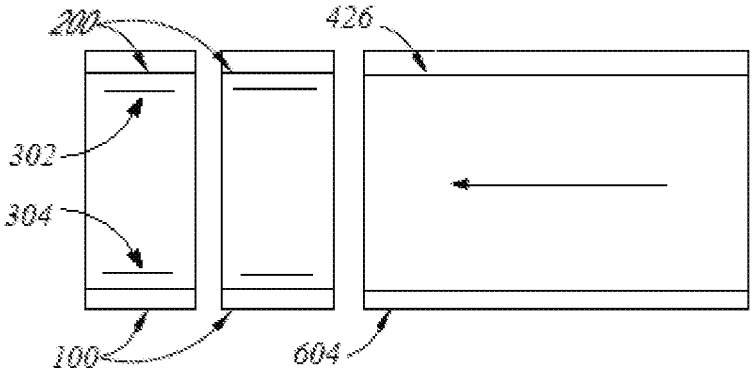

FIGS. 5 and 6 illustrate an optional system 400 for manufacturing the resilient member 200 and heat sealing the resilient member 200 to a frame member 100. The manufacturing system illustrated in FIG. 5 can be made from well-known plastic film processing equipment, such as those components in systems available from the Hudson-Sharp Machine Company. The various rollers, folders, cutters, guides, perforators, and heat sealing devices are all well-known and commercially available. Those of the ordinary skill in the art understand how to arrange the various components described below in order to achieve the function and results described below.

With reference now to FIG. 5, the manufacturing system 400 can include a source portion 420, a heat sealing portion 520, a cutting portion 550 and a frame material feed portion 600.

The source portion 420 of the system 400 can include one or more source rolls of raw material for making the resilient member 200. In the illustrated embodiment, the source portion 420 can comprise, in some embodiments, a roll 422 of raw material for forming the resilient member 200. As is well known in the art, the roll 422 is mounted so as to provide some resistance against turning, so as to thereby maintain an acceptable minimum tension.

As illustrated in FIG. 5, a strip of film 426, during operation, will unroll from the roll 422 and be pulled into the system 400 for processing, as described below. The material 426 is used for forming the body 202 of the resilient member 200. In some embodiments, the strip 426 can have a melt index below 9. Those of ordinary skill in the art are familiar with the use of the term "melt index." in particular, the "melt index" is a number that is assigned to a poly film and helps to organize the various types of poly into general groupings based upon the melting temp of the resin they are made out of. The softer the material, then usually the lower the melt index will be assigned to that material.

In the illustrated embodiment, the heat sealing portion 520 and the cutting portion 550 are integrated into single component referred to herein as the heat sealing device 552. However, other configurations can also be used. In the illustrated embodiment, the heat sealing device 552 is configured to form one or more heat seals between the strip 426 and the frame material 604, such as corrugated, fed towards the heat sealing portion 520 and cutting portion 550 via a feed device 602. It should be noted that any materials from which the frame member 100 can be made can be fed using the feed device 602. Moreover, it should be noted that the frame material 604 can either be unfinished frame material which has not yet been cut to size and/or include folds, partially unfinished frame material which has not yet been completely cut to size and/or include all folds, or finished frame material which has already been fully cut with all folds fully formed. In addition, the frame material 604 can have coating layers applied to surfaces of the frame material 604 for embodiments of a frame member, such as frame member 100, in which a coating layer can be used for heat sealing.

The heat sealing device 552 can also be configured to cut the strip 426. In embodiments where the frame material 604 is unfinished or partially unfinished, the heat sealing device 552 can be used to also cut the frame material 604 into a frame member, such as frame member 100 individual heat-sealed packaging assemblies such as packaging assembly 140 can then be discharged from the device 552. The heat-sealed assemblies can then be placed in a container 650 where they can be temporarily stacked and stored.

With reference to FIG. 6, the heat sealing device 552 can include one or more heat sealing heads, such as heat sealing head 553, and cutting heads, such as cutting head 554, mounted so as to reciprocate relative to the incoming strip 426 and frame material 604. The heat sealing head 553 and cutting head 554 can be timed relative to the movement of the strip 426 and the frame material 604 so as to provide the final product with the desired shape. The heat sealing head 553 and the cutting head 554 can reciprocate orthogonally to the strip 426 and the frame material 604. The heat sealing head 553 and the cutting head 554 can also reciprocate laterally with respect to the heat sealing head 553 and the cutting head 554.

The cutting head 554 can include a cutting portion 560. In some embodiments, the cutting head can also include a first heat sealing portion (not shown) and a second heat sealing portion (not shown) proximate the cutting portion 560. As the strip 426 and frame material 604 move under the heat sealing head 553 and cutting head 554, the heads can move downwardly and press the cutting portion 560 down into the strip 426 and, in some embodiments the frame material 604, so as to simultaneously cut the strip 426 into a resilient member 200 and, in some embodiments, the frame material 604 into a frame member 100, as well as heat seal the strip 426 onto the frame material 604 along heat seals 302, 304. In embodiments with the cutting head 554 including a first heat sealing portion and a second heat sealing portion, this can also be used to potentially heat seal other portions of the strip 426 to the frame material 604.

It should be understood that, in some embodiments, the heat seals can be created along a lower surface of the frame material 604 such as is shown in FIG. 3C, Accordingly, in some embodiments, a folding device (not shown) can be used to fold the ends of the strip 426 over the ends of the frame material 604 such that a portion of the strip 426 is located adjacent a lower surface of the frame material 604 to which these portions can then be heat sealed. Moreover, it should also be understood that some slack may be desired during the heat sealing process. Accordingly, in some embodiments, the strip 426 can folded or pinched along a portion between the heat seals 302, 304 such that, upon heat sealing and releasing of the folded portion or pinched portion, the resulting resilient member 200 has some degree of slack for allowing an article to be packaged therein. Of course, other methods of introducing some slack can be performed. For example, the heat seal can be formed when the frame material 604 is at least partially folded toward a tensioned state as shown in FIG. 4. Accordingly, the strip 426 can be heat sealed to the frame material 604 while the strip 426 remains taut.

The heat sealing portion 552 can include a conveyor system to carry the strip 426 and the frame material 604 into the area beneath the heat sealing head 553 and cutting head 554 to be cut and heat sealed. The conveyor system can then carry the assembled frame member 100 and resilient member 200 away from the heat sealing head 553 and the cutting head 554. In some embodiments, a cooling device, such as a forced convection device can be located downstream of the heat sealing device 552 to expedite cooling of the heat seal. Of course, a forced convection device is entirely optional particularly in cases where the heat seal can be air cooled effectively.

In some embodiments, the assembled frame member 100 and resilient member 200 can then be stacked in a container 650 where they can be allowed to further cool. Due to the assembled frame member 100 and resilient member 200 being stacked such that the heat sealed resilient member 200 is placed between two frame members 100, the risk of two assemblies sticking together is reduced since a recently heat-sealed resilient member 200, after cooling slightly, will stick to a frame member 100 stacked on top of it. As should be understood by those of skill in the art, this risk can be further reduced by allowing the assemblies to cool before being stacked in container 650. Accordingly, in some embodiments, the conveyor can be extended further such that the assemblies are provided additional time to cool or by including a cooling device downstream of the heat sealing device 552. As such, the assemblies can be stacked in an automated manner, using well known high speed/high volume devices for aligning dropping items into a container. Thus, some embodiments can help reduce man power required for production and thus reduce production costs.

Optionally, the cutting portion 560 can be configured to only perforate or score the strip 426 and/or frame material 604 so that the resilient members 200 and/or frame members 100 are still attached but easily separable from each other.

As noted above, the strip 426 can be made from materials having different melt indexes. The melt index of a material refers to the temperature at which the material will begin to flow and thereby can form clean heat seals. Most materials have different melt index values. The melt index values of many soft polys vary from about 7.0 to 9.7. Thus, the strip 426 can be conveniently heat sealed to frame material 604 if the melt index is in the range of about 7.0 to about 10.0, they can be easily heat sealed together using the above-described apparatus 400 and provide clean heat seals.

Further, the strip 426 can have different moduli of elasticity. A more flexible material can be used or a relatively stiffer material can be used. For example, the strip 426 can be a polyurethane or a low density polyethylene. In this example, a six inch wide, 24 inch long strip of low density polyethylene will stretch only about six inches before failure while a six inch wide by 24 inch long strip of polyurethane will stretch 18 inches before failure. In some embodiments, the strip 426 can be formed from two types of materials with certain materials being used along portions which are heat sealed and other materials being used for other portions. In some embodiments, between about 0% to about 40%, between about 5% to about 30%, between about 10% to about 20%, about 15%, or any other value including those within these ranges of the resilient member 200 can be formed from a different material.

The thicknesses of the strip 426 can also be different along different portions. For example, depending on the application, strip 426 can be thicker along portions which are heat sealed as well as areas proximate the portions to be heat sealed whereas the strip 426 can be thinner along others portions. This can potentially enhance the strength of the bond of the resilient member 200 when it is attached to the frame member 100. In some embodiments, between about 0% to about 40%, between about 5% to about 30%, between about 10% to about 20%, about 15%, or any other value including those within these ranges of the resilient member 200 can have a greater thickness than the remaining portions. This can help save cost of materials because thinner materials are less expensive, less waste, etc.

Multi-Layer Resilient Member

Figure 7:
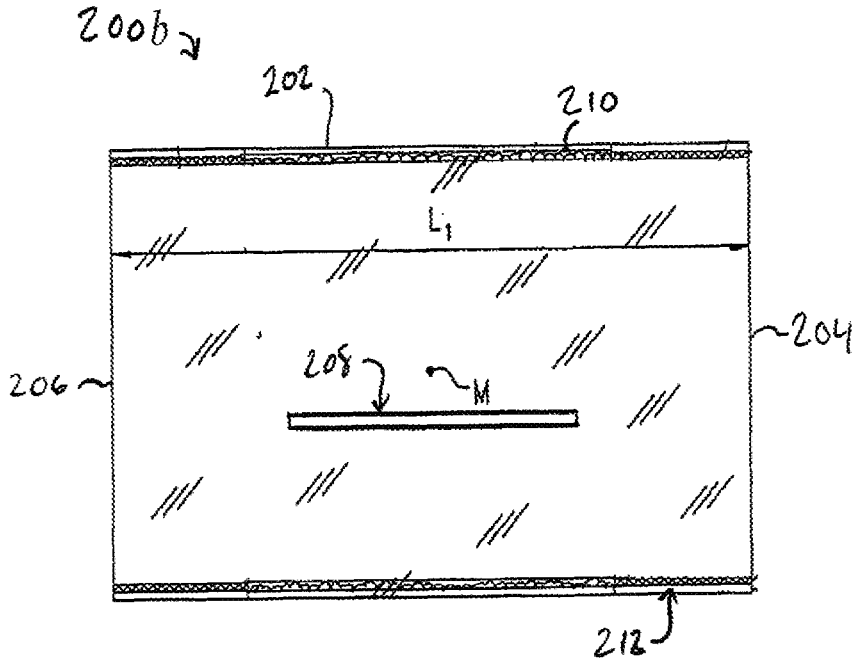
FIG. 7 is a plan view of a resilient member formed of two layers.

With reference to FIG. 7, in some embodiments, the resilient member 200*b* can be formed from one or more resilient materials, then can optionally include an opening device 208. As the resilient member 200*b* of FIG. 7 is similar to the resilient member 200 described in connection with FIG. 2, similar reference numbers are used to reference similar features. Moreover, reference should be made to the discussion of the resilient member 200 for further details regarding resilient member 200*b*. The resilient member 200*b* is configured to engage and cooperate with the frame member 100. Optionally, the resilient member 200*b* can be configured to engage the foldable portions 112, 114 of the frame member 100 so as to, among other options, generate tension in the resilient member 200*b* when the foldable portions 112, 114 are folded relative to the central portion 110.

The resilient member 200*b* can be formed from a resilient body 202. For purposes of convenience for the following description, the body 202 is identified as having a midpoint M position in the vicinity of the middle of the resilient body 202. Resilient body 202 can also include end portions 204, 206 disposed at opposite longitudinal and thereof. In the illustrated embodiment, the resilient member 200*b* is formed from two pieces of resilient material connected together, and sized to cooperate with the foldable portions 112, 114 of the frame member 100. As illustrated in FIG. 7, heat sealing lines 210, 212 extend along lateral edges of the resilient body 202 and act to secure two layers of material to each other One of ordinary skill in the art will appreciate that there are numerous methods for securing the two layers of material to each other. However, it has been found that heat sealing is particularly advantageous as it does not require expensive adhesives and the time consuming steps required for using such adhesives. However, such adhesives can be used if desired. Welding processes (e.g., induction welding), fusing techniques, and the like can also be used to form the heat sealing lines 210, 212 as well as any other heat sealing described herein.

The resilient member 200*b*, in some embodiments, has a Length $L_1$ that is sized depending in the devices with which the resilient member 200*b* is to cooperate, such as goods. Similar to the resilient member 200 described in connection with FIG. 2, the Length $L_1$ can be sized such that when the resilient member 200*b* is in its final state, e.g., engaged with the foldable portions 112, 114, it generates the desired tension for the corresponding packaging application.

The resilient member 200*b* can be formed of any resilient material. In some embodiments, the resilient member 200*b* can be formed of two layers of polyethylene films, low density polyethylene (LDPE), polyurethane, TPU, or virtually any polymer, or plastic film. The density of the layers of film can be varied to provide the desired retention characteristics such as overall strength, resiliency, and vibrational response. Preferably the density of the material used to form the resilient member 200*b* is determined such that the resilient member 200*b* is substantially resilient when used to package a desired article. Each of the layers used to form resilient member 200*b* can be monolayer or multilayer sheet depending on the application.

Figure 8:
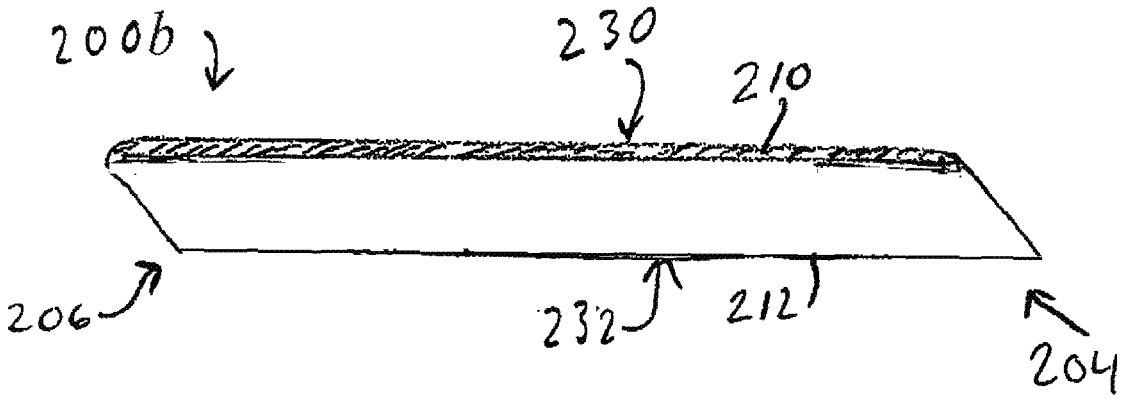
FIG. 8 is a perspective view of the resilient member illustrated in FIG. 7.

As illustrated. In FIG. 8, the resilient member 200*b* can be formed from an upper layer of resilient material 230 and a lower layer of resilient material 232. The layers 230, 232 can be attached to each other along the heat sealing lines 210, 212 so as to form a void there between.

Figure 9:
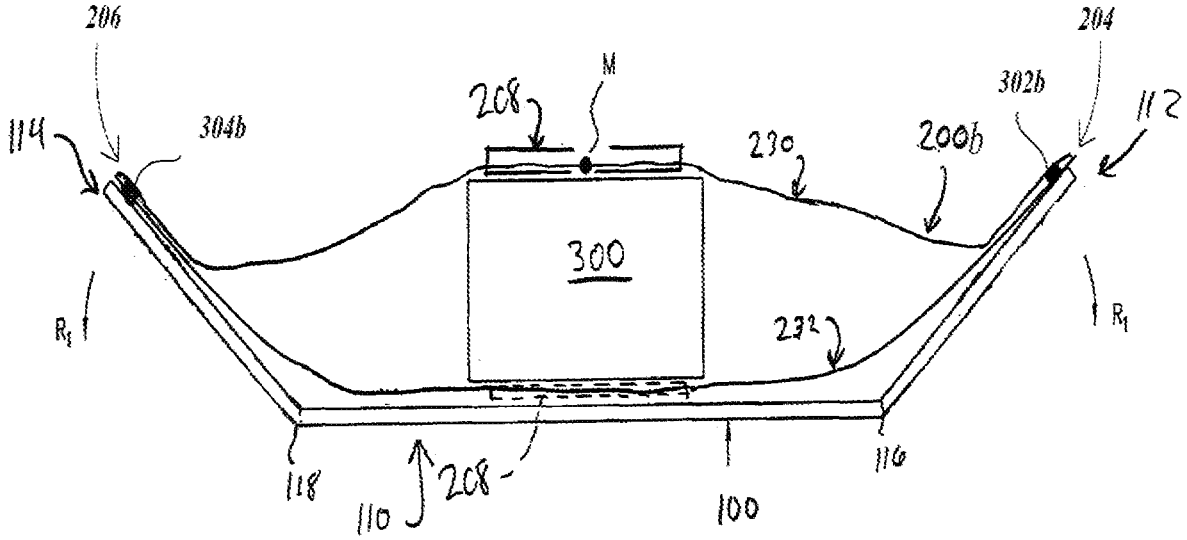
FIG. 9 is a schematic side elevational view of an assembly including the frame member of FIGS. 1A and 1B and the resilient member of FIGS. 7 and 8 connected together with an article packaged therewith showing a heat sealing location similar to that of FIG. 3B.

As illustrated in FIG. 9, which is similar to the embodiment shown in FIG. 3B with the use of resilient member 200*b* in lieu of resilient member 200, the frame member 100 can be used in conjunction with the resilient member 200*b* with the resilient member 200*b* being attached to the frame member 100 via heat seals 302*b*, 304*b*. Similar to the embodiment described in connection with FIGS. 3A-C, heat seals can also be located at other positions depending on design requirements.

Due to the dual layer design of retention member 200*b*, the article to be packaged 300 can be inserted between the resilient member 200*b* and the frame member 100 or between the upper and lower layers 230, 232 of the resilient member 200*b*. For example, in some embodiments, the resilient member 200*b* can include the opening device 208 which can be configured to allow the article 300 to be inserted into the space between the upper and lower layers 230, 232. In some embodiments, the opening device 208 can be in the form of perforations in the upper layer 230 configured to allow the upper layer 230 to be ruptured and opened thereby allowing the insertion of the article 300 into the space between the upper and lower layers 230, 232.

In other embodiments, the opening device 208 can be in the form of a zipper, a tongue-and-groove zip-type closure member, Velcro®, low strength adhesives, flaps, magnets, or any other type of closing device.

Optionally, the opening device 208 can be positioned on the lower layer 232 (illustrated in phantom line in FIG. 9). This configuration can provide further advantages. For example, with the opening device 208 positioned on the lower layer, 232, the opening device 208 is juxtaposed to and faces toward the central portion 110 of the frame member 100. As such, it is less likely that the article 300 can inadvertently pass through the opening device 208 and exit the space between the layers 230, 232.

In some embodiments, opening devices 208 can be provided on both of the upper and lower layers 230, 232. As such, the resilient member 200*b* can be used in various ways, allowing the article to be inserted into the space between the layers 230, 232 through either of the opening devices 208 on either layer 230, 232.

Figure 10:
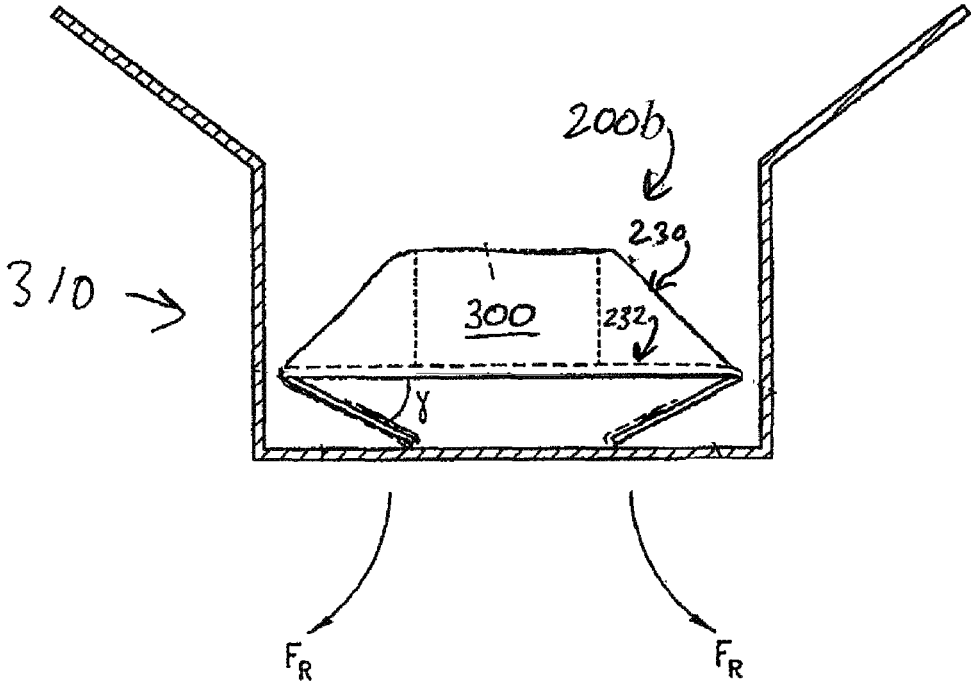
FIG. 10 is a schematic side elevational view of the assembly of FIG. 9 disposed inside a container.

With reference now to FIGS. 9 and 10, with the article 300 disposed in either the space between the upper and lower layers 230, 232 or between the lower layer 232 and the upper surface of the central portion 110, and with the foldable portions 112, 114, engaged with the end 204, 206 via heat seals, the foldable portions 112, 114 can be rotated downwardly in the direction of arrows $R_1$. In this initial movement from the position illustrated in FIG. 9, the foldable portions 112, 114 move away from the midpoint M of the resilient member 200*b*, thereby creating tension in the resilient member 200*b*.

As the foldable portions 112, 114 are further pivoted downwardly about the fold lines 116, 118, until they are doubled back adjacent to the lower surface of the central portion 110, the foldable portions 112, 114, continue to add additional tension into the resilient member 200*b*, and more particularly, the upper and lower layers 230, 232 of the resilient member 200*b*. The frame member 100 and the resilient member 200*b* can be configured to form a swing when disposed in a box or container 310 in the arrangement shown in FIG. 10. For example, the frame member 100 itself can have some shape memory such that the fold lines 116, 118 provide some resistance to movement. Additionally, as noted above, the Length $L_1$ of the resilient member 200*b* can provide tension, resisting the further bending movement of the foldable portions 112, 114 about the fold lines 116, 118, respectively.

Accordingly, when the frame member 100, resilient member 200*b*, and the article 300 are arranged in the configuration shown in FIG. 10 inside the container 310, reaction Forces $F_r$ resist downward movement of the article 300, thereby providing additional cushioning for the article 300.

Further, the container 310 can define a maximum inner height, for example, when the lid portion of the container 310 is closed. With the maximum inner height set to a dimension less than the maximum overall height of the article 300 and frame member 100, the foldable portions 112, 114 are maintained such that the angular position (FIG. 10) is maintained at an angle more acute that 90 degrees. Thus, the foldable portions are maintained in an orientation in which the frame member 100 and resilient 200 work together to act as a shock absorbing spring for the article 300.

Figure 11:
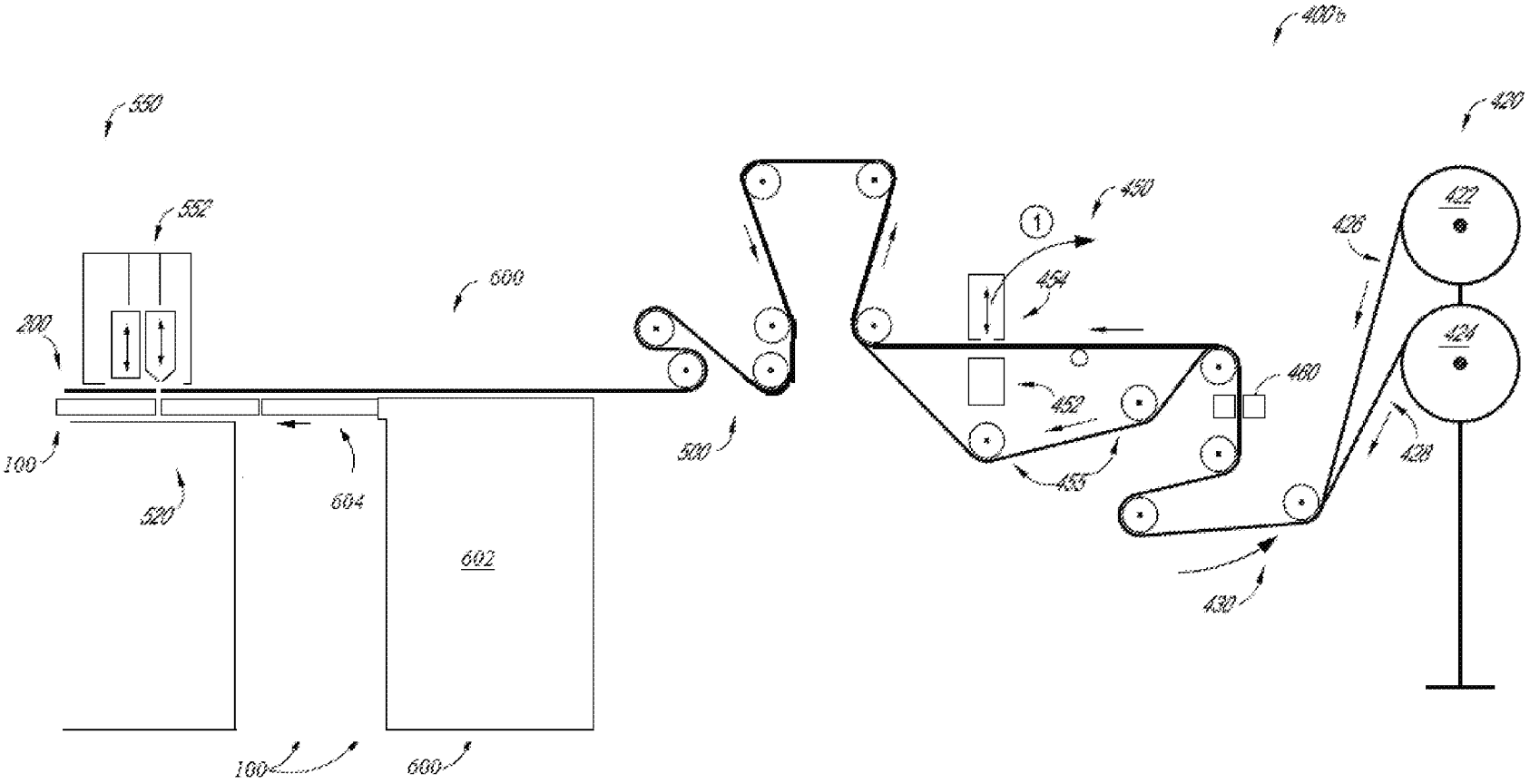
FIG. 11 is a schematic view of a manufacturing system that can be used to manufacture the frame member and resilient member assembly illustrated in FIG. 9.
Figure 12:
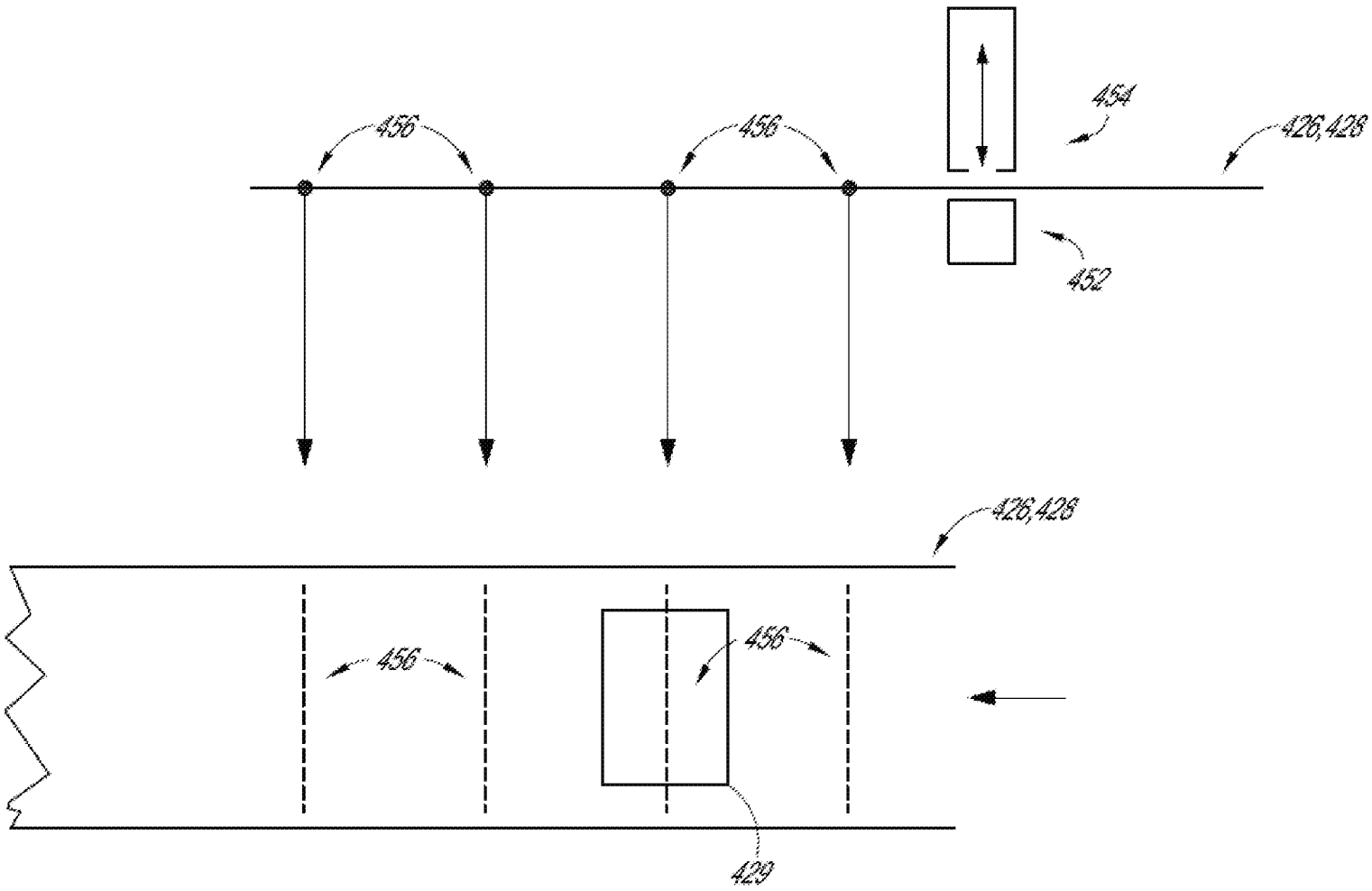
FIG. 12 is a schematic illustration illustrating the function of an opening device that can be used at an opening station in the system of FIG. 11.
Figure 13:
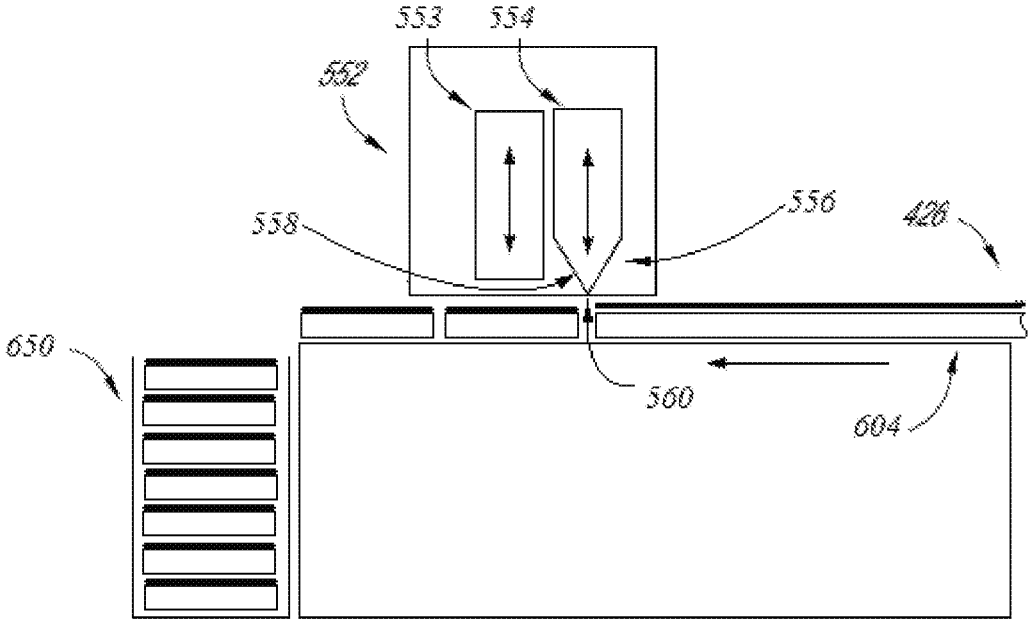
FIG. 13 is a schematic illustration of a heat sealing and cutting device of the system of FIG. 11 which heat seals and cuts apart frame members and resilient members from the continuous strips of FIG. 11.
Figure 13:
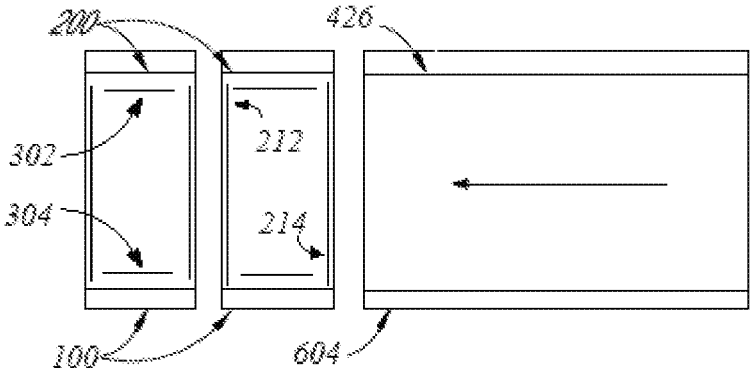

FIGS. 11 to 13 illustrate an optional system 400*b* for manufacturing the resilient member 200*b* and heat sealing the resilient member 200*b* to a frame member 100. As the system 400*b* of FIG. 11 is similar to the system 400 described in connection with FIG. 5, similar reference numbers are used to reference similar features. Moreover, reference should be made to the discussion of the system 400 for further details regarding system 400*b*. In addition, it should be understood that the components of system 400*b* can be incorporated in the system 400. The various rollers, folders, cutters, guides, perforators, and heat sealing devices are all well-known and commercially available. Those of the ordinary skill in the art understand how to arrange the various components described below in order to achieve the function and results described below.

With continued reference to FIG. 11, the manufacturing system 400*b* can include a source portion 420, an opening device portion 450, a drive portion 500, a heat sealing portion 520, a cutting portion 550, and a frame material teed portion 600.

The source portion 420 of the system 400*b* can include one or more source rolls of raw material for making the resilient member 2*b*00. In the illustrated embodiment, the source portion 420 can comprise, in some embodiments, one or more rolls of raw material for forming the resilient member 200*b*. In the illustrated embodiment, a first roll 422 serves as a source of the upper layer of film for forming the upper layer 230 of the resilient member 200*b* and the second roll 424 serves as a source for the material performing the second lower layer 232 of the resilient member 200*b*. In the illustrated embodiment, the rolls 422, 424 are approximately the same width. However, it should be understood that rolls of different width can also be used.

Additionally, as described above, the material on the rolls 422, 424 can be different kinds of materials, different thicknesses and have different melting indexes. Additionally, as well known in the art, the rolls 422, 424 are mounted so as to provide some resistance against turning, so as to thereby maintain an acceptable minimum tension.

As illustrated in FIG. 11, a strip of film 426, during operation, will unroll from the roll 422 and be pulled into the system 400*b* for processing, as described below. Similarly, a strip of material 428, during operation, unrolls from the roll 424. The material 426 is used for forming the upper layer 230 of the resilient member 200*b* and the second strip 428 is used for forming the lower layer 232 of the resilient member 200*b*. In some embodiments, the strips 426, 428 can have a melt index below 9.

The source 420 can also include one or more tensioning rollers 430 configured for maintaining tension in the strips 426, 428 as they are pulled through the system 400*b*. The tensioning of such layers of material is well known to those of ordinary skill in the art, and thus is not described in further detail.

Optionally, as noted above, the manufacturing apparatus 400 can include an opening portion 450 configured to provide the opening device 208 to the resilient member 200*b*. In the illustrated embodiment, the opening device portion 450 is configured to perforate the strip of material 426 so as to form an opening device 208 in the resilient member 200*b*. In some embodiments, the opening portion 450 can include a block member 452 and a cutting head 454. In such an arrangement, the cutting head 454 can include a cutting blade (not shown) configured to reciprocate in a direction perpendicular to the material 426 in a timed fashion so as to create perforations at desired locations.

For example, as shown in FIG. 12, the cutting device 454 reciprocates upward and downwardly to create a series of perforations 456 at spaced locations along the material 426. The block 452 can provide support for the material 426 as the cutting device 454 perforates the material 426. In some embodiments, both strips can be routed through the cutting device 454, so as to provide opening device 208 in both layers 426, 428.

Optionally, the system 400*b* can include a set of diverter rollers 455, configured to allow the lower strip 428 to bypass the opening portion 450. Thus, the opening portion can selectively provide opening devices 208 to only one or to both of the strips 426, 428.

In some embodiments, one of or both of the strip 426, 428 can include printed portions 429, such as advertising, trade names, trademarks, logos, coupons, or other indicia. Thus, the resulting resilient member 200*b* can include such printing on one or both of the layers 426, 428. In some embodiments, one or both of the layers 426, 428 can be pre-printed with the desired printed portions 429. For example, in some embodiments, the printed portions 429 can be applied to the layer 428 and the layer 426 can be translucent or transparent. Thus, during use, the printed portions 429 can be viewed through the upper layer 426 (layer 230 in FIG. 9).

With continued reference to FIG. 11, the system 400*b* can approximately include a registration device 460 configured to provide a registration function for the timing of actuation of the opening device 450, the heat sealing portion 520, cutting portion 550, a feed portion 600 or any other device that may be used to selectively alter the strips 426, 428 at desired locations. For example, one or more of the strips 426, 428 can be provided with one or more detectable registration marks, such as visible lines (e.g., black marker), which can be used as a registration mark by the registration device 460. The registration device 460 can include an optical sensor (not shown) configured to detect such a registration mark, and to output a signal that can be used to control the various parts of the system 400*b* to trigger actuation at the desired timing so as to produce the desired effects to the strips 426, 428 at the desired location. Such registration devices 460 are well known in the art and thus are not described in greater detail below.

Using such as registration device 460, the system 400*b* can be configured to create opening devices and heat seals in locations that are at predetermined spacings from the printed portions 429. For example, the opening devices 208 can be centered on the printed portions 429 and the cuts created by the cutting portion 550 can be disposed between the printed portions 429. Other spaced relationships can also be used.

With continued reference to FIG. 11, the drive portion 500 of the manufacturing system 400*b* can include a plurality of rollers, one or more of which can be driven with a motor so as to provide a substantial portion of the force for pulling the strips 426, 428 through the various portions of the manufacturing system 400*b*. The configuration of such a set of drive rollers is well known in the art and is not described in greater detail below. However, generally, the control of the speed of the drive rollers 500 is synchronized and otherwise controlled to be in a timed relationship with the operation of the tension portion 430, opening portion 450, registration device 460, heat sealing portion 520, cutting portion 550, and feed portion 600 with a programmable logic controller, a dedicated processor, a general purpose computer, a hard-wired controller, or the like.

In the illustrated embodiment, the heat sealing portion 520 and the cutting portion 550 are integrated into single component referred to herein as the heat sealing device 552. However, other configurations can also be used. In the illustrated embodiment, the heat sealing device 552 is configured to form one or more heat seals between the layers of the strips 426, 428 and the frame material 604, such as corrugated, fed towards the heat sealing portion 520 and cutting portion 550 via a feed device 602.

The heat sealing device 552 can also cut the strips 426, 428, between the two parallel heat seals. In embodiments where the frame material 604 has not been fully cut, the heat sealing device 552 can be used to also cut the frame material 604 into frame member 100. Individual resilient member 200*b* and frame member 100 heat-sealed assemblies can then discharged from the device 552. The heat-sealed assemblies can then be placed in a container 650 (FIG. 6) where they can be temporarily stacked and stored.

With reference to FIG. 13, the heat sealing device 552 can include one or more heat sealing heads, such as heat sealing head 553, and cutting heads, such as cutting head 554, mounted so as to reciprocate relative to the incoming strips 426, 428 and frame material 604. As with the opening portion 450, the heat sealing and cutting head 554 can be timed relative to the movement of the strips 426, 428 so as to provide the final product with the desired shape.

The heat sealing and cutting head 554 can include a cutting portion 560. In some embodiments, the cutting head can also include a first heat sealing portion 556 and a second heat sealing portion 558 adjacent proximate the cutting portion 560. As the strips 426, 428 and frame material 604 move under the heat sealing head 553 and cutting head 554, the heads can move downwardly and press the cutting portion 560 down into the strips 426, 428 and, in some embodiments, the frame material 604 so as to simultaneously cut those the strips 426, 428 into a resilient member 200*b* and, in some embodiments, the frame material 604 into a frame member 100, as well as heat seal the strips 426, 428 onto the frame material 604 along heat seals 302, 304 and together along heat seals 210, 212. In embodiments with the cutting head 554 including a first heat sealing portion 556 and a second heat sealing portion 558, these portions 556, 558 can be used to form heat seals such as heat seals 210, 212, heat seals the strips 426, 428 directly to the frame member 100, or a combination of both.

The heat sealing portion 552 can include a conveyor system to carry the strip 426, 428 and the frame material 604 into the area beneath the heat sealing head 553 and cutting head 554 to be cut and heat sealed. The conveyor system can then carry the assembled frame member 100 and resilient member 200*b* away from the heat sealing head 553 and the cutting head 554. In some embodiments, a cooling device, such as a forced convection device can be located downstream of the heat sealing device 552 to expedite cooling of the heat seal. Of course, a forced convection device is entirely optional particularly in cases where the heat seal can be air cooled effectively. The assembled frame members 100 can then be stacked in a container 650.

Optionally, the cutting portion 560 can be configured to only perforate or score the strips 426, 428 and/or frame material 604 so that the resilient members 200 and/or frame members 100 are still attached but easily separable from each other.

As noted above, the strips 426, 428 can be made from materials having different melt indexes. The melt index of a material refers to the temperature at which the material will begin to flow and thereby can form clean heat seals. Most materials have different melt index values. The melt index values of many soft polys vary from about 7.0 to 9.7. Thus, the layer strips 426, 428 can have different melt indexes and conveniently if those melt indexes are in the range of about 7.0 to about 10.0, they can be easily heat sealed together using the above-described system 400*b* and provide clean heat seals.

Further, the strips 426, 428 can have different moduli of elasticity. In some embodiments, for example, more flexible material can be used as the top layer 426 while a relatively stiffer layer can be used as the lower layer 428. For example, the upper layer, and some embodiments is a polyurethane while a low density polyethylene is used as the lower layer 428. Although these materials behave very differently with regard to failure, they can be easily heat sealed together using the system 400*b* described above and provide the desired shock absorption for packaging articles 300 described above. As described above, the one or more of the strips, such as strips 426, 428, can be formed from two types of materials with certain materials being used along portions which are heat sealed and other materials being used for other portions.

The thicknesses of the strips, such as strips 426, 428, can also be different compared to each other. In addition, the thickness of the strips can also be different along different portions as described above. Moreover, the widths of the strips 426, 428 can be slightly different. For example, the width of the strip 428 can be greater than the width of the strip 426. Thus, when heat sealed together, the ends of the lower layer 232 can extend beyond the ends of the upper layer 230. This can be particularly advantageous, for example, heat sealing the lower layer 232 to the frame material 604 is more effective. This can be the case, for example, if the strip 428 is a material which more suitable for heat sealing to the frame material 604 such as the raw frame material or a coating on the frame material 604. The strip 426 can then be heat sealed along portions of its periphery, such as described herein, to the strip 428 rather than the frame material 604. Of course, it should be understood that strip 426 can also be heat sealed to the frame material 604.

Further, because various different kinds of material can be heat sealed together as described above, the colors of the materials can also be different. For example, the strip 426 could be translucent or transparent and the strip 428 could be translucent or opaque. Thus, the strip 428 could include printed portions 429 that can be seen through the layer formed by the strip 426. The printed portions could be any form of advertising, including but without limitation, trademarks, trade names, service marks, logos, coupons, etc.

Heat Sealing Procedures

With reference now to FIGS. 14A-B and 15A-B, heat sealing of the resilient member 200, either directly to an outer layer of the frame member 100 or to a coating layer, such as coating layer 130, is described in further detail. It should be understood that these same processes can be applied to heat sealing of any resilient sheet member, such as resilient member 200*b*, to any frame members described herein.

Figure 14A:
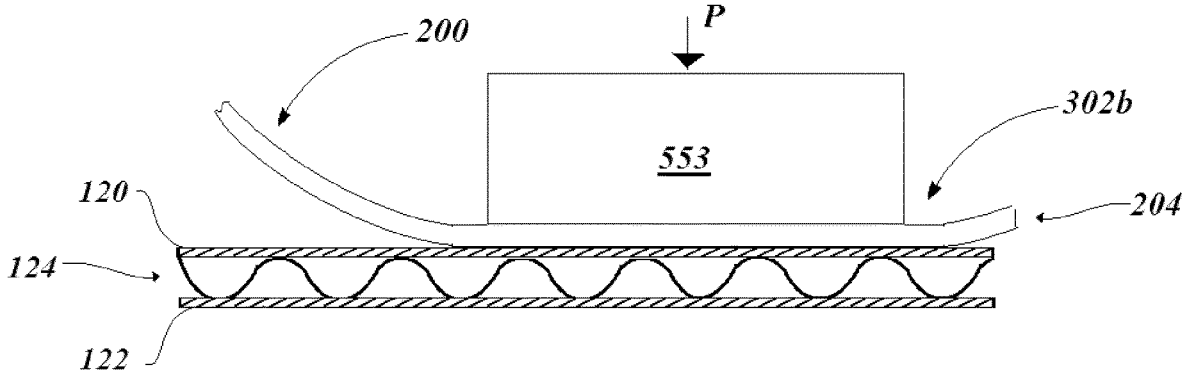
FIG. 14A is a cross-sectional view along line A-A of a frame member similar to that of FIG. 1A showing a resilient member being heat sealed to the frame member where the frame member does not have a coating.
Figure 14B:
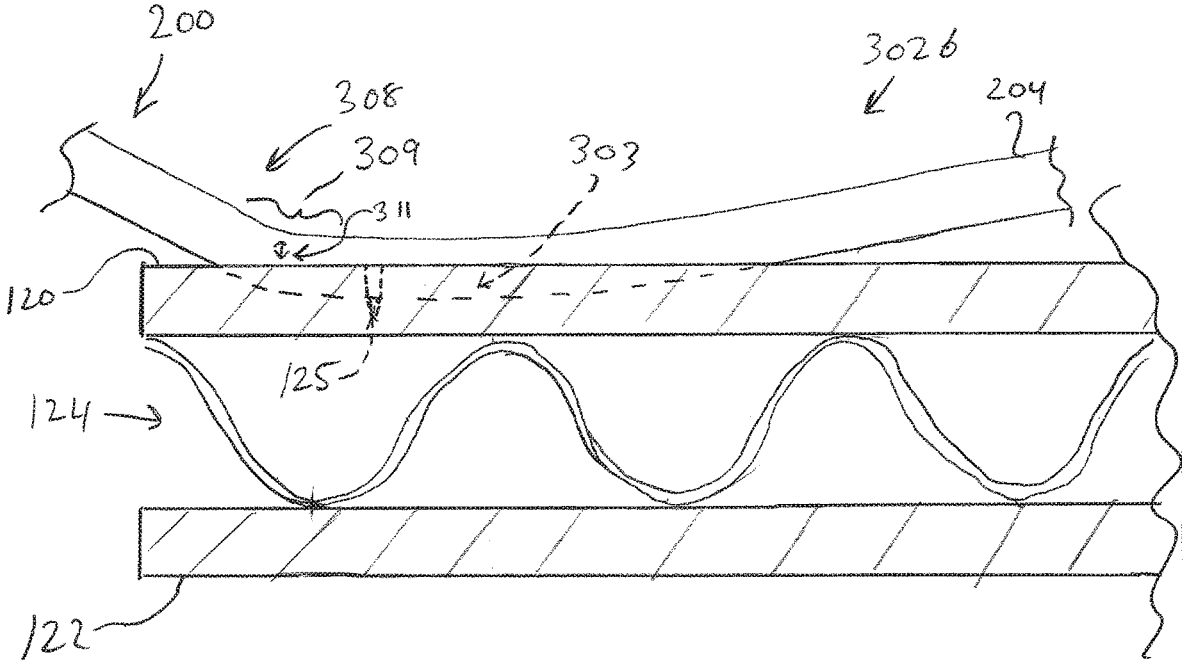
FIG. 14B is a cross-sectional view of the frame member of FIG. 14A showing a heat seal.

With reference first to FIGS. 14A and 14B, heat sealing of the resilient member 200 is shown where the resilient member 200 is heat sealed directly to an outer layer, more specifically the top layer 120, of the frame member 100. As shown in FIG. 14A, heat can be applied using a heating source, such as heat seal head 553, to the resilient member 200. Moreover, the heating source can apply a force P on the resilient member 200 in a direction towards the top layer 120 such that the resilient member 200 is compressed between the heat seal head 553 and the top layer 120.

Generally, the amount of heat and pressure applied to the resilient member 200 can be chosen so as to be sufficient to cause the resilient member 200 to soften and/or partially melt so as to generate a connection to the top layer 120. The amount of heat applied can be controlled by selecting an appropriate temperature for the heat seal head 553 and controlling the amount of time this temperature is applied to the resilient member 200. The temperature can also be varied as a function of time and/or force applied. The amount of pressure can be controlled by controlling the amount of force applied to the heat seal head 553, such as via motors or other mechanisms. The pressure can also be varied as a function of time and/or the temperature applied.

In some embodiments, the temperature, pressure and times of application of each can be chosen such that the resilient member 200 can form a bond, upon cooling and solidifying, with a material to which it is placed adjacent during the heat sealing process. For example, in the illustrated embodiment, the temperature, pressure and times of application of each can be chosen such that the resilient member 200 forms a bond with an outer layer, such as the top layer 120. For example, in some embodiments, the upper layer 120 can be made from a fibrous material, such as those noted above commonly used for forming outer layers of materials known as "corrugated cardboard". In such embodiments, the temperature, pressure and times of the heat sealing process can be chosen such that at least some of the resilient member 200 flows into close contact with the fibers forming the upper layer, thereby forming a connection that is enhanced with a mechanical engagement of the material of the resilient member 200 and the surfaces of the fibers contained in the upper layer 120. The more the resilient member 200 flows into and around the fibers, the stronger the connection between the fibers and the. FIG. 14B illustrates a portion of the resilient member 200 having flowed into and become entangled and/or mechanically engaged with the upper layer 120.

In some embodiments, the resilient member 200 can melt and flow through pores or openings of the outer layer and into cavities 125 of the inner layer 124. Such cavities 125 can be formed during the processes for manufacturing the upper layer 120 or at any time after manufacturing. For example, although not illustrated, a "pricking" device can be used to generate one or a plurality of cavities 125 with the upward openings at the first surface of the upper layer 120. Thus, when the resilient member 200 is heated during the heat sealing process, some of the resilient member 200 can flow more readily into the cavities 125, thereby enhancing a connection between the resilient member 200 and the upper layer 120. Further, in some examples, a heat sealing head can be modified to include a plurality of pins which simultaneously form a cavities 125 and heat the resilient member 200 sufficiently to cause the material forming the resilient member 200 to flow into the cavities 125. Other techniques can also be used.

With continued reference to FIG. 14B, upon cooling and solidifying, portions 303 of the resilient member can be located within an interior 303 of the upper layer 120. In some embodiments, it is possible for some of the resilient member 200 to pass completely through the upper layer 120. Without being limited to a particular theory of operation, by allowing the resilient member 200 to at least soften and come into close contact with the outer layer 120, the resilient member 200 can solidify in such a manner as to connect with and optionally become integrated with the structure of the outer layer 120. By increasing the temperature, one can potentially expedite the speed at which the material forming the resilient member 200 can flow into contact with outer layer 120 by causing the resilient member 200 to become more free-flowing. Moreover, by increasing the pressure, one can also potentially expedite the speed at which this flow into contact with the outer layer 120 occurs by application of additional force in the direction of flow toward the outer layer 120. However, it should be understood that application of too much heat and/or pressure can weaken the structure of the resilient member 200 upon cooling. This is particularly important to consider in light of the significant stresses applied to the resilient member 200 when placed in tension. For example, with continued reference to FIG. 14B, the resilient member 200 can be considered as including a transition area 309 spanning the portion of the resilient member 200 which includes a terminal end area of the part of the resilient member 200 that has flowed into an interior 303 or cavities 125 of the upper layer 120 and a portion of the resilient member 200 which is free to move, or at least pivot, relative to the upper layer 120. This transition area 309 can be considered as forming a hinge between the portion of the resilient member 200 that is directly connected to the upper layer 120, and the portion of the resilient member 200 that can pivot relative to the upper layer 120.

If too much temperature and/or pressure had been applied during the associated heat sealing process, too much of the resilient member 200 might flow into the upper layer 120, thereby leaving a thickness 311 that is insufficient to maintain a reliable connection between the free portion of the resilient member 200 and the upper layer 120, for example, allowing the resilient member 200 to tear in the vicinity of the transition portion 309 when subjected to a load during normal use. One of ordinary skill in the art, in light of the description set forth herein, can determine the appropriate amount of pressure and/or temperature to use in order to provide a transition portion 309 with sufficient strength.

Fibrous materials, such as cardboard, paperboard, paper, and the like can include pores or openings. Additionally, as discussed above, other types of porous materials can be used for the outer layer. Moreover, in some embodiments, to enhance the ability for the resilient member 200 to flow into cavities 125 of the inner layer 124, a separate device can be incorporated in the manufacturing system, such as systems 400, 400*b*, to create additional pores or openings at least along portions of the frame member 100 on which the resilient member is to be heat sealed. This device can include one or more pins, needles or other puncturing devices to create pores or openings. This device can also be part of the heat sealing head 553 or cutting head 554. The size of the pores or openings can be chosen to allow sufficient flow into the inner layer 124. In some embodiments, rather than creating pores or openings, a device can be used to create one or more slits at least along portions of the frame member 100 on which the resilient member is to be heat sealed. Creation of pores, openings, or slits can help improve the strength of the heat seal of the resilient member 200 to the frame member 100 and reduce the temperature, pressure and/or time of application of each to form the heat seal 302*b*.

Figure 15A:
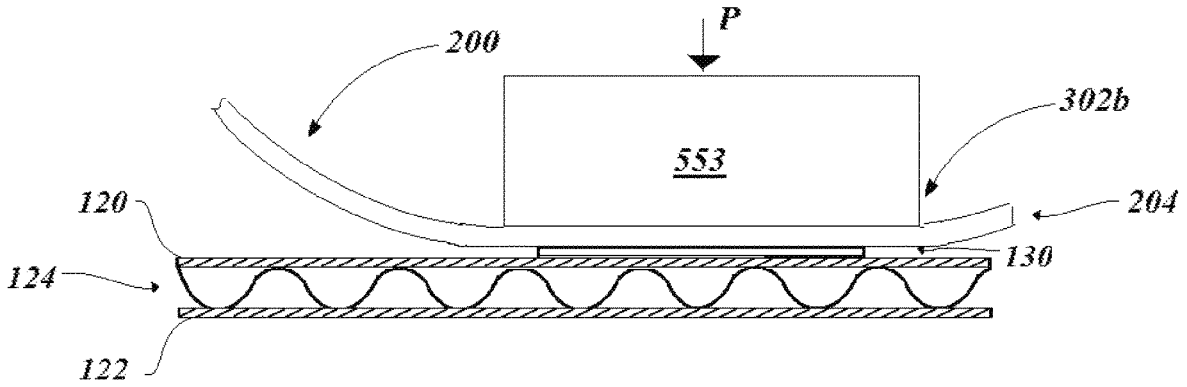
FIG. 15A is a cross-sectional view along line A-A of a frame member similar to that of FIG. 1A showing a resilient member being heat sealed to the frame member where the frame member has a coating.
Figure 15B:
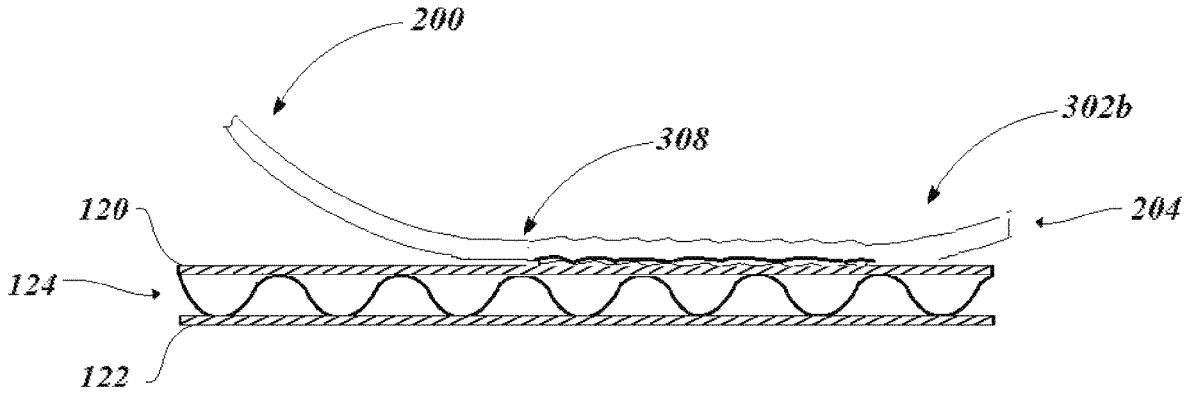
FIG. 15B is a cross-sectional view of the frame member of FIG. 15A showing a heat seal.

With reference now to FIGS. 15A and 15B, heat sealing of the resilient member 200 is shown where the resilient member 200 is heat sealed to a coating on an outer layer, more specifically coating 130 on the top layer 120, of the frame member 100. As shown in FIG. 15A, heat can be applied using a heating source, such as heat seal head 553, to the resilient member 200. Moreover, the heating source can apply a force P on the resilient member 200 in a direction towards the top layer 120. The discussion above with respect to heat sealing directly to the outer layer can apply; however, it should be understood that the temperatures, pressures, and times of application of each can be different from that discussed with respect to healing directly to the outer layer. More specifically, in the illustrated embodiment, the temperature, pressure and times of application of each can be chosen such that the resilient member 200 forms a bond with the coating 130.

For example, in embodiments where the resilient member 200 is formed from a polymer or plastic-based material and the coating 130 is also formed from a polymer or plastic-based material, the resilient member 200 and/or coating 130 can melt such that the resilient member 200 and coating 130 bond upon cooling and solidifying. Moreover, it should also be appreciated that some degree of flow of the resilient member 200 and/or coating 130 through the outer layer, such as top layer 120, can also occur. Reference should be made above to discussion above in connection with FIGS. 14A and 14B for details regarding such flow and methods of enhancing such flow.

As shown in FIGS. 14B and 15B, upon forming a heat seal 302*b*, a transition area 308 is formed between the heat-sealed portion of the resilient member 200 and the free (i.e., non heat-sealed) portion of the resilient member 200. Since this transition area serves as a "hinge" for the resilient member and can be subject to significant stress upon tensioning the resilient member 200, the temperatures, pressures and times of application of each, as well as the materials and thickness of the resilient member 200, should be chosen such that the "hinge" or transition area does not fail by breakage or other failure modes upon tensioning. Thus, temperatures, pressures, and times of application cannot be too high such that structural integrity along this area is compromised.

The following temperatures, pressures and times of applications can be used for heat sealing the resilient member 200 directly to the frame member 100:

| Material | Seal Temp. (° F. ) | Time (Sec. ) | Pressure (lb. f/in) |
|---|---|---|---|
| Polyurethane | 225 | 15 | 0.5 |
| | 300 | 7 | 1.5 |
| | 550 | 1 | 5 |
| | 800 | 0.5 | 10 |
| Polyethylene | 245 | 15 | 0.06 |
| | 350 | 5 | 1.5 |
| | 650 | 1 | 5 |
| | 850 | 0.5 | 10 |
| Polypropylene | 290 | 15 | 0.065 |
| | 400 | 5 | 1.5 |
| | 750 | 1 | 5 |
| | 900 | 0.5 | 10 |
| Polystyrene | 300 | 15 | 0.065 |
| | 425 | 5 | 1.5 |
| | 800 | 1 | 5 |
| | 900 | 0.5 | 10 |

The temperatures, pressures and times noted above provide acceptable results. Additionally, ranges of variations from the above, specifically listed temperatures, pressures and times also provide acceptable results. Magnitudes of such ranges of variations can be affected by various other parameters, such as environmental temperature, starting temperature of the materials, environmental humidity, variations in material compositions, impurities in the materials, impurities in the air, etc. In light of the ranges of variations that can provide acceptable results, as used herein for characterizing values of temperatures, pressures and times, the term "about" is intended to mean that a variation of about 10% of the stated number is included. For example, the statement "polyurethane heat sealed at a temperature of about 225° F., for about 15 seconds, at a pressure of about 0.5 lb. f/in" is intended to include at least "a temperature of 202.5-247.5° F., for 13.5-16.5 seconds, at a pressure of 0.49-0.51 lb. f/in". Larger ranges of included values may also be included.

In some embodiments, the heat sealed areas of the resilient member 200 can account for between about 1% to 40% of the total area of the resilient member 200, between about 5% to about 30% of the total area of the resilient member 200, between about 10% to about 20% of the total area of the resilient member 200, about 10% of the total area of the resilient member 200, or any other value including those within these ranges. Moreover, in some embodiments, the area of the resilient member 200 between the heat sealed portions can account for between about 50% to about 99% of the total area of the resilient member 200, between about 65% to about 95% of the total area of the resilient member 200, between about 80% to about 90% of the total area of the resilient member 200, about 90% of the total area of the resilient member 200, or any other value including those within these ranges. In some embodiments, the heat sealed areas of the resilient member 200 can account for between about 1% to 40% of the total area of the frame member 100, between about 5% to about 30% of the total area of the frame member 100, between about 10% to about 20% of the total area of the frame member 100, about 10% of the total area of the frame member 100, or any other value including those within these ranges.

The manufacturing process as herein described can be modified to produce other articles, such as differently shaped frame members, to which a resilient member can be attached.

Side Wall Retention Packaging Frame Member

With reference to FIGS. 16-19, another embodiment of a retention packaging assembly is shown therein. The retention packaging assembly includes a frame member 780 and a resilient member 200*c*, similar to resilient members 200, 200*b*, which cooperate with each other to form the packaging assembly 784.

Figure 16:
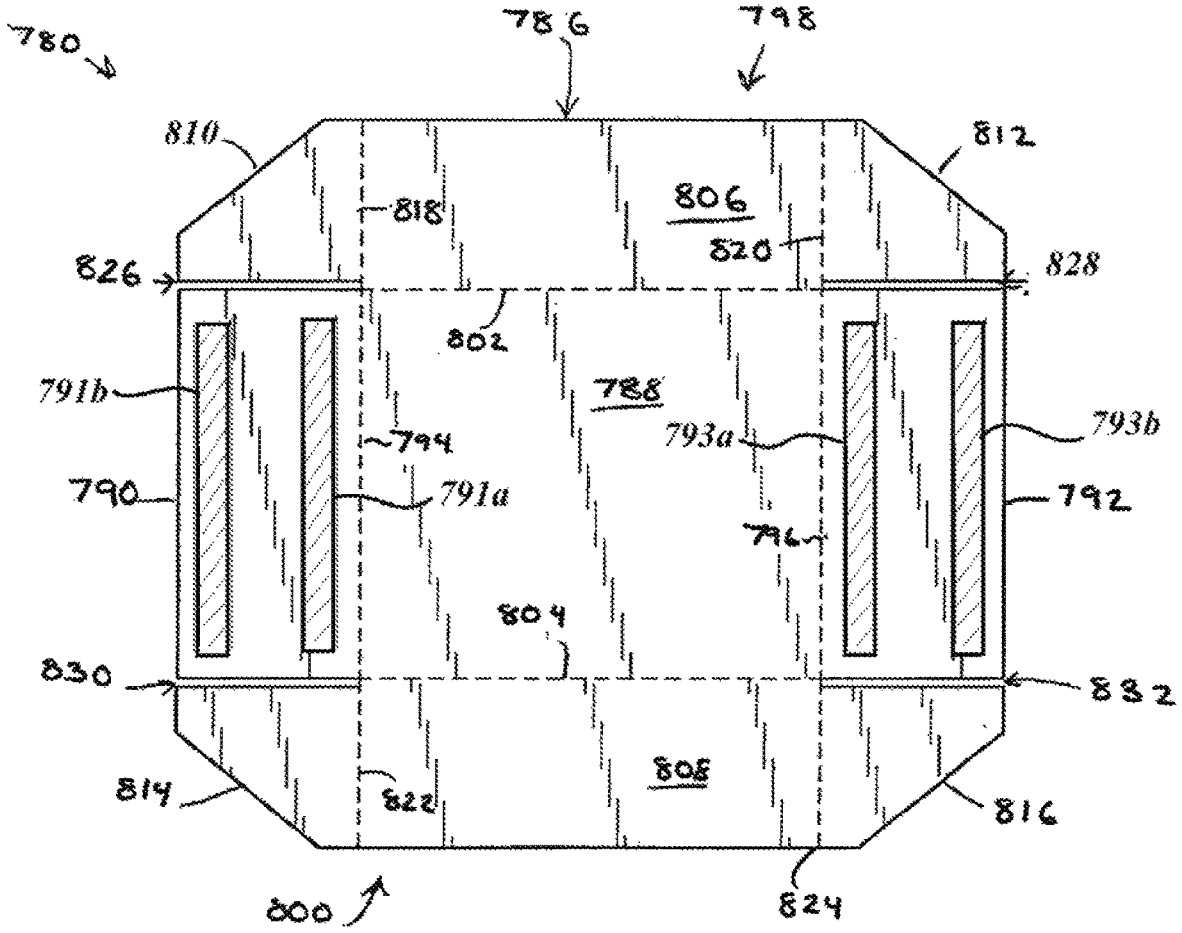
FIG. 16 is a top plan view of another embodiment of a frame member in an unfolded state showing potential locations for heat seals.

As shown in FIG. 16, the frame member 780 is formed of a rigid body member 786. In the illustrated embodiment, the rigid body 786 is generally rectangular. However, it will be apparent to one of ordinary skill in the art that the rigid body 786 can be formed in various other shapes according to the desired overall characteristics of the packaging assembly 784. As shown in FIG. 16, the rigid body 786 includes a central portion 788 having a first rotatable portion 790 and a second rotatable portion 792, each being connected to the central portion 788 at fold lines 794, 796, respectively. The construction of the rigid body 786 and the fold lines 794, 796, as well as other fold lines included on the rigid body 796 discussed below, can be constructed in accordance with the description in U.S. Pat. No. 6,675,973, which has been expressly incorporated by reference in its entirety.

As shown in FIG. 16, the rigid body 786 includes side walls 798, 800 which are connected to the central portion 788 along fold lines 802, 804, respectively. The side walls 798, 800 are each divided into a main panel 806, 808 and side panels 810, 812, 814, 816. The side panels 810, 812 are connected to the main panel 806 at fold lines 818, 820, respectively. Similarly, the side panels 814, 816, are connected to the main panel 808 at fold lines 822, 824, respectively.

Preferably, clearances 826, 828, 830, 832 are formed between the side panels 810, 812, 814, 816, and the rotatable portions 790, 792. The clearances 826, 828, 830, 832 provide gaps between the rotatable portions 790, 792 and the side panels 814, 816 such that when a user rotates the rotatable portions 790, 792 around the fold lines 794, 796, respectively, the rotatable portions 790, 792 rotate freely and thus, are not impeded by the side panels 810, 812, 814, 816.

As shown in FIG. 16, there are different portions on which the resilient member 200*c* can be heat sealed to the device. Along the upper surface, several locations of heat seals, 791*a*, 791*b*, 793*a*, 794*b* are illustrated. Moreover, heat seals can also be located along the lower surface of the frame member 780. Reference is made to FIGS. 3A-C which illustrate a frame member 100 which includes similar design aspects to that of frame member 780. As shown in FIGS. 3A-C, the heat seals 302*a-c*, 304*a-c*, can be positioned at various locations on the frame member 100 including both the upper and lower surfaces. In a similar fashion, heat seals, such as heat seals 302*a-c*, 304*a-c* can be positioned at various locations on the frame member 780. Moreover, reference should be made to the discussion in connection with FIGS. 3A-C for determining placement of the heat seals on the frame member 780 as well as operation of the frame member 780. For example, heat seals 791*a* and 793*a* can be used for packaging smaller and/or lighter articles while heat seals 791*b* and 793*b* can be used for packaging larger and/or heavier articles.

Figure 17:
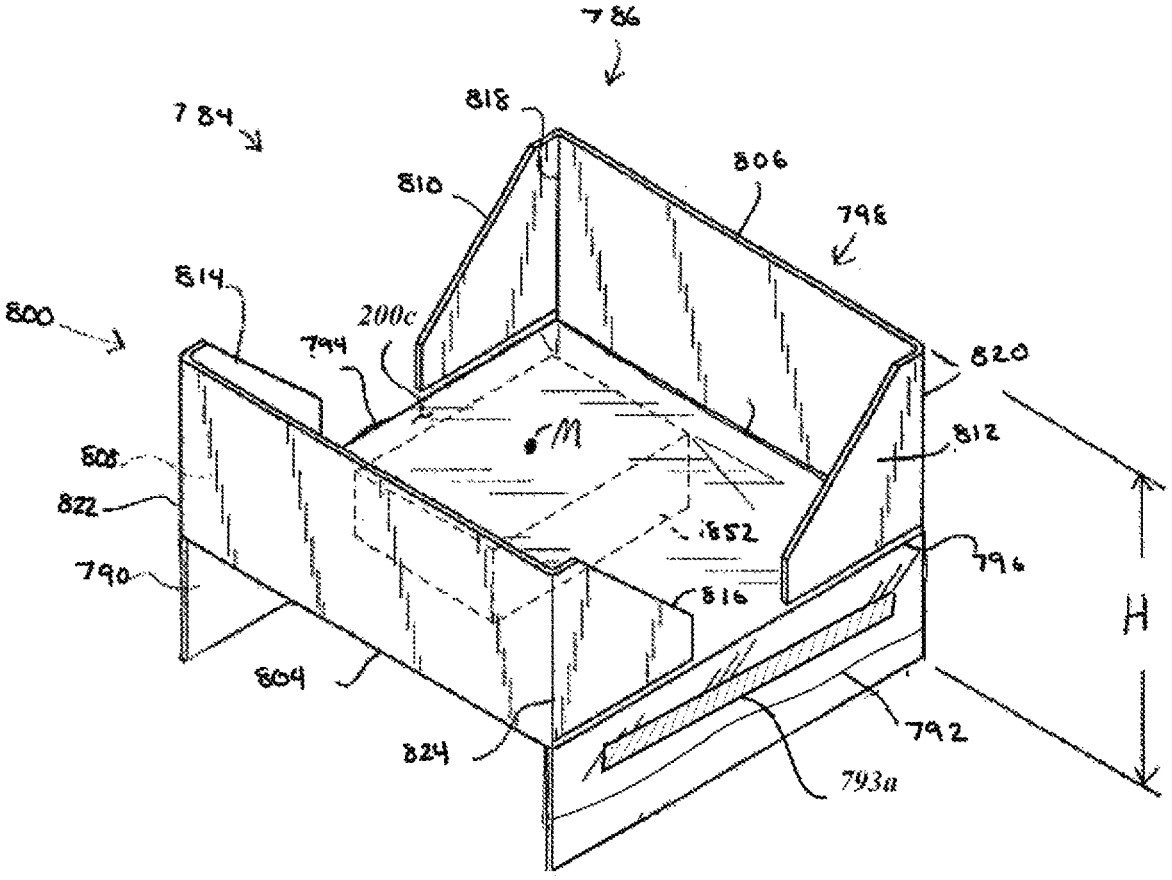
FIG. 17 is a perspective view of the assembly shown in FIG. 16, with the rotatable portions of the frame member rotated downwardly so as to tighten the resilient member over the article to be packaged and with side walls of the frame member folded upwardly.

With reference to FIG. 17, as noted above, the frame member 780 can include side walls 798, 800. As shown in FIG. 17, the side walls 798, 800 can be folded upwardly so as to provide further protection for the article 852. In the illustrated embodiment, the side walls 798, 800 have been folded upwardly along fold lines 802, 804, respectively. Additionally, the side panels 810, 812 have been folded inwardly, as viewed in FIG. 17, along fold lines 818, 820, respectively. Similarly, side panels 814, 816 have been folded inwardly along fold lines 822, 824, respectively. In this position, the assembly 784 defines a maximum overall height H.

Figure 18:
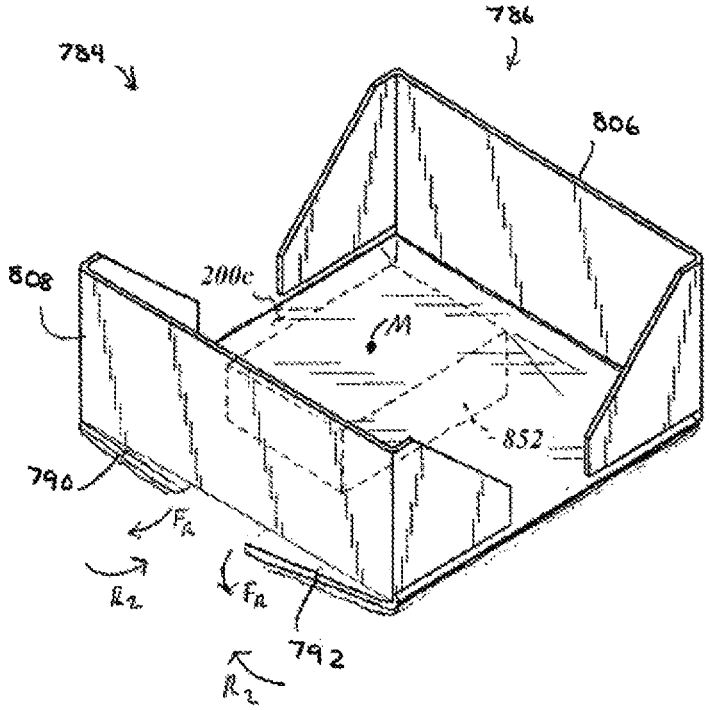
FIG. 18 is a perspective view of a modification of the assembly shown in FIG. 18, with the rotatable portions of the frame member folded to a more extreme angle so as to form additional cushions of the assembly.
Figure 19:
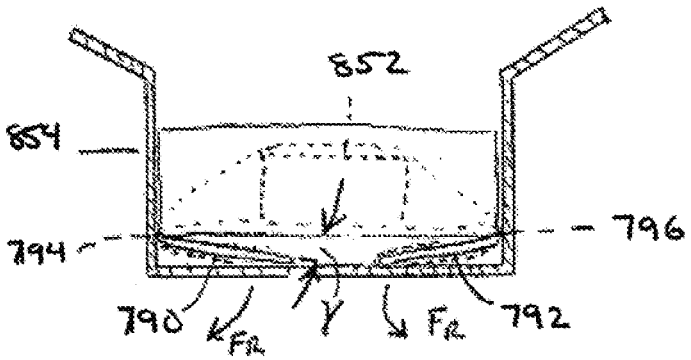
FIG. 19 is a schematic side elevational view of the assembly of FIG. 17 disposed inside a container.

With reference to FIG. 16, by providing clearances 826, 828, 830, 832 between the rotatable portions 790, 792 and the end panels 810, 812, 814, 816, the rotatable portions 790, 792 can be easily rotated from the position such as is shown in FIGS. 3A-C to the position shown in FIGS. 18 and 19 without contacting the end panels 810, 812, 814, 816, particularly when the resilient member 200*c* is engaged with the rotatable portions 790, 792.

With reference to FIG. 18, the length $L_1$ of the retention member optionally can be configured such that the rotatable portions 790, 792 and the resilient member 200*c* itself forms a further cushioning device or a spring. For example, as shown in FIG. 19, the rotatable portions 790, 792 have been rotated in the direction of arrows $R_2$ from the position illustrated in FIG. 17, to an angle γ which is substantially greater than 90°. With the rotatable portions 790, 792 rotated to such a position, further tension can be generated in the resilient member 200*c* thus causing a reaction force to bias the rotatable portions 790, 792 in the direction of arrow $F_R$. Where the frame member 780 is formed of cardboard, the reaction forces along the arrows $F_R$ are further enhanced due to the tendency of cardboard to return to an unfolded state, despite the formation of fold lines, such as the fold lines 794, 796, i.e., the "fibrous memory" of cardboard creates a cantilever-type spring effect. Accordingly, when the assembly 784 is positioned within a shipping container such as a box 854, the reaction force $F_R$ provides additional cushioning to the article 852. Thus, the length $L_1$ of the resilient member 200*c* can be configured such that the rotatable portions 790, 792 and the resilient member form a spring, thus providing a reaction force and cushioning for the article 852.

Clamshell Suspension Packaging Frame Member

Figure 20:
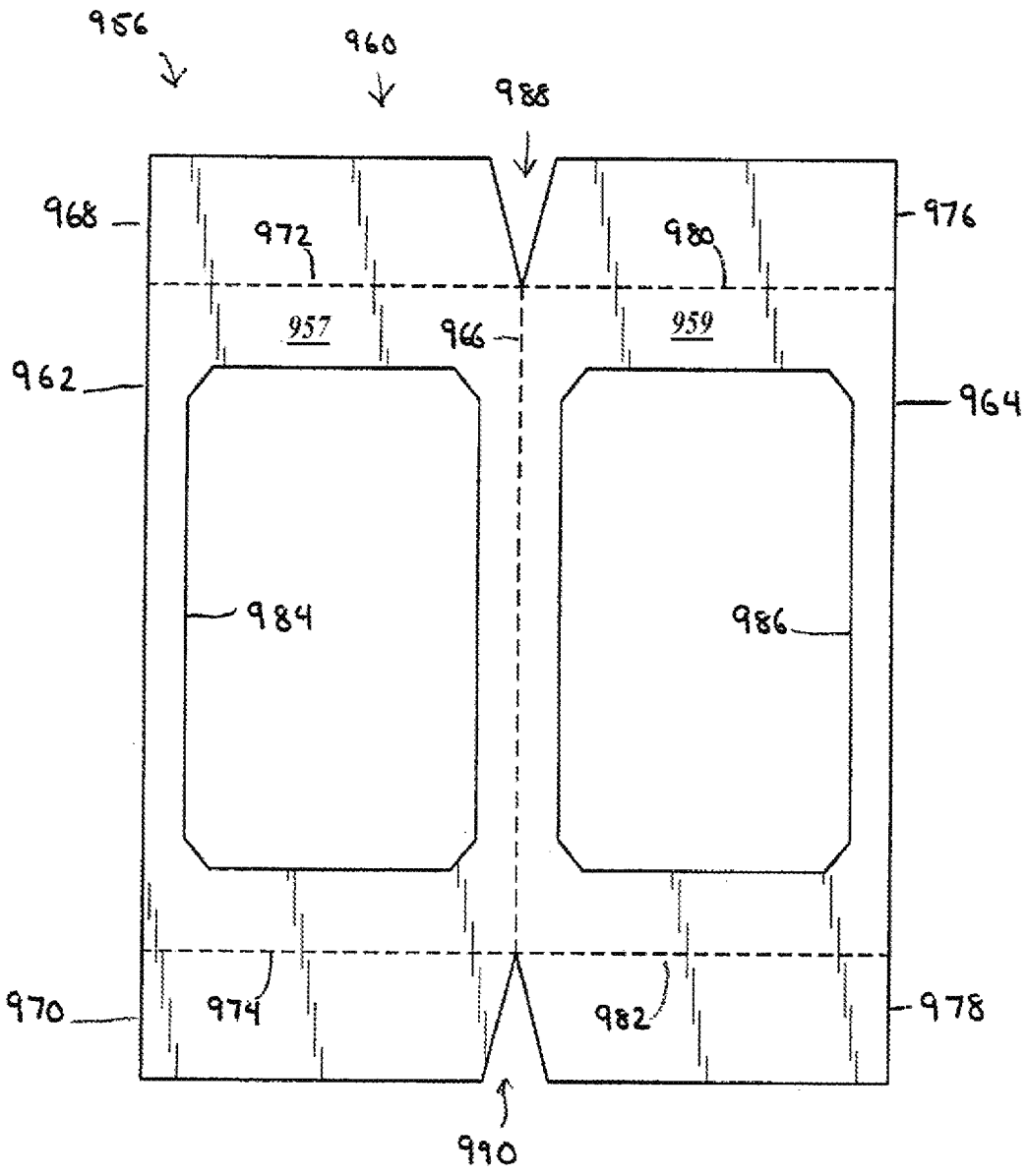
FIG. 20 is a top plan view of another embodiment of a frame member in an unfolded state having rotatable portions.
Figure 21:
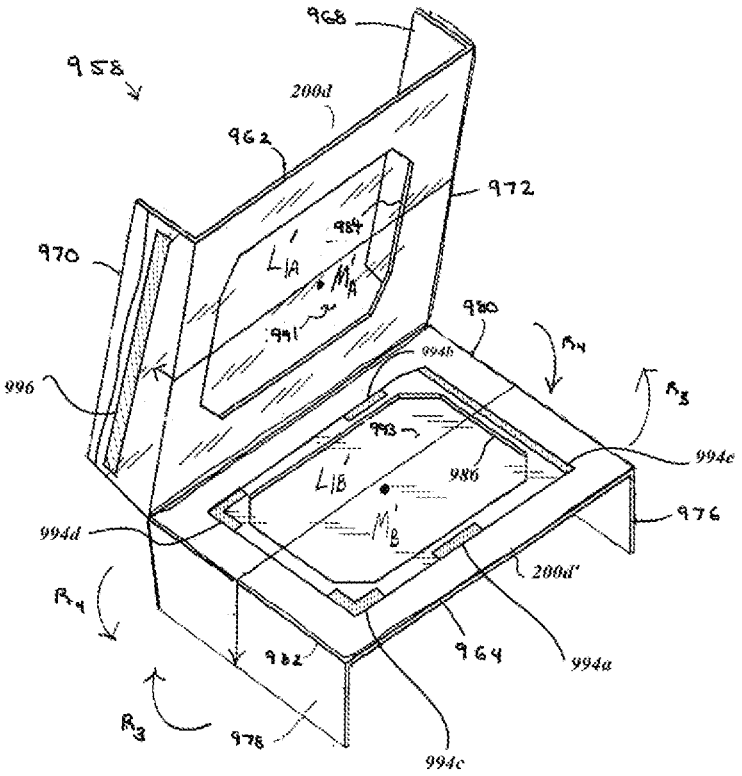
FIG. 21 is a perspective view of the frame member shown in FIG. 21 in a partially folded state with two resilient members assembled with the frame member such that the rotatable portions of the frame member shown in FIG. 20 are heat sealed to the resilient members.
Figure 22:
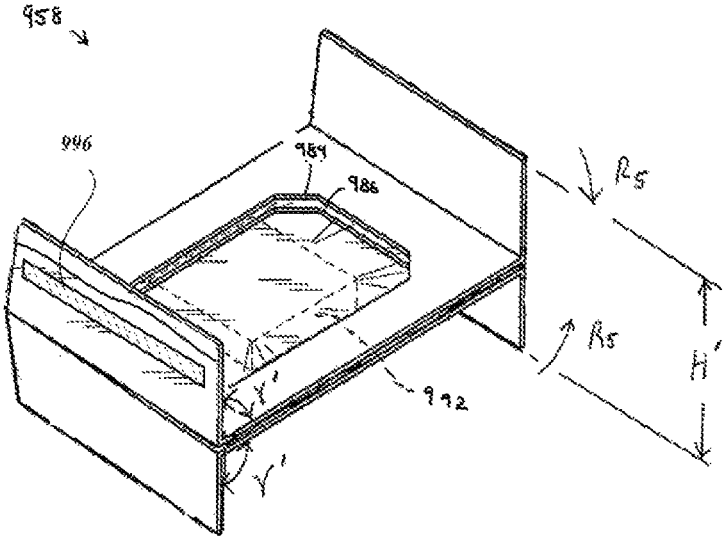
FIG. 22 is a perspective view of the assembly shown in FIG. 21 with the frame member folded to a more extreme state and with an article to be packaged disposed between unsupported portions of the resilient members.

With reference to FIGS. 20-22, a frame member 956 and two resilient members 200*d*, 200*d*', similar to resilient members 200, 200*b*, cooperate to form a packaging assembly 958, as illustrated in FIG. 22. Further details regarding this embodiment can be found in U.S. Pat. No. 6,675,973, which has been expressly incorporated by reference in its entirety.

As shown in FIG. 20, the frame member 956 is formed of a rigid body 960 having first and second panel members 962, 964 connected along a fold line 966. The first panel portion 962 includes first and second rotatable portions 968, 970 which are connected to the first panel portion 962 along fold lines 972, 974, respectively to central portion 957. Similarly, first and second rotatable portions 976, 978 are connected to the second panel portion 964 along fold lines 980, 982, respectively to central portion 959. The construction of the rigid body 960 and the fold lines 966, 972, 974, 980, 982 is preferably in accordance with the description of the frame member 780 illustrated in FIGS. 16, 20 and 21.

In the illustrated embodiment, as shown in FIG. 20, the first and second panel members 962, 964 include apertures 984, 986 in the central portions 957, 959. The apertures 984, 986 are the inform of through holes formed in the first and second panel members 962, 964, respectively. Additionally, the frame member 956 is provided with a notch 988 provided between the rotatable portions 968 and 976. The notch 988 provides clearance between the rotatable portion 968, 976. Similarly, the frame member 956 includes a notch 990 formed between the rotatable portions 970, 978. The function of the notches 988, 990 will be described below.

With reference to FIG. 21, as noted above, the assembly 958 includes two resilient members 200*d*, 200*d*' each engaged with one of the panel members 962, 964. Thus, for clarity, the resilient member labeled as 200*d* is illustrated as engaged with the first panel member 962 and a second resilient member labeled as 200*d*' is illustrated as engaged with the second panel member 964. As shown in FIG. 21, the rotatable portions 968, 970 are attached to resilient member 200*d* via a heat seal 996 on rotatable portion 970 and a heat seal (not shown) on rotatable portion 968. Resilient member 200*d*' is attached to panel 964 via multiple heat seals 994*a-e*. As such, unsupported spans 991, 993 of the resilient members 200*d*, 200*d*', respectively are formed over the apertures 984, 986, respectively. It should be noted that heat seal location 996 can allow use of a larger resilient members such as resilient member 200*d*. In contrast, heat seal locations 994*a-e* can allow use of smaller resilient members such as resilient member 200*d*'. While the illustrated embodiment illustrates the use of two different sized resilient members 200*d*, 200*d*', it should be understood that resilient members of the same size can be used. Moreover, these heat seal locations are just for illustrative purpose and need not be used. For example, only certain of heat seals 994*a-e* can be used. Moreover, the heat seals can also be placed along the opposite surfaces from for example, heat seal 996, to allow use of even larger resilient members.

Resilient members 200*d*, 200*d*' have lengths $L_{1A}$', $L_{1B}$', respectively, which are configured such that the rotatable portions 968, 970, and 976, 978 can be moved between positions in which the resilient members 200*d*, 200*d*' are slackened and positions in which the resilient members 200*d*, 200*d*' are tightened. For example, although not illustrated, the rotatable portions 976, 978 shown in FIG. 21, can be rotated upwardly towards the mid-point $M_B$' in the directions indicated by arrows $R_3$. With the rotatable portions 976, 978 rotated to such a position, the resilient members 200*d*, 200*d*' can be slid over the rotatable portions 976, 978. Afterwards, the rotatable portions 976, 978 can be rotated away from the $M_B$' in the direction indicated by arrows $R_4$, to the position illustrated in FIG. 21. In this position, the resilient member 200*d*' is tightened across the second panel member 964. Thus, it is advantageous to configure the length $L_{1B}$' of the resilient member 200*d*' to produce the desired tension when the rotatable portions 976, 978 are rotated to the position shown in FIG. 21.

It is apparent to one of ordinary skill in the art that the length $L_{1B}$' can be adjusted accordingly to generate the desired tension and in light of the overall strength of the frame member 956 and the strength of the resilient member 200*d*'.

As shown in FIG. 22, with the resilient member 200*d* engaged with the first panel member 962 and the resilient member 200*d*' engaged with the second panel member 964, an article to be packaged 992 can be placed between the resilient members 200*d*, 200*d*' and generally aligned with the apertures 984, 986 formed in the first and second panel members 962, 964, respectively. As such, when the first and second panel members 962, 964 are rotated towards each other, in the directions indicated by arrows $R_5$, such that the article 992 is disposed between the resilient members 200*d*, 200*d*'. As such, the unsupported spans 991, 993 of the resilient members 200*d*, 200*d*' protrude through the apertures 984, 986, respectively and thereby substantially envelope the article 992 within the respective resilient members 200*d*, 200*d*'. Thus, the article 992 can be solely suspended by the resilient members 200*d*, 200*d*' without contacting the frame member 956. Accordingly, the cushioning effect and vibration dampening provided by the assembly 958 is determined largely by the mechanical characteristics of the material used to form the resilient members 200*d*, 200*d*' and partially to the overall mechanical characteristics of the frame member 956.

With reference to FIG. 22, when the rotatable portions 968, 970 and 976, 978 are oriented such that they form an angle γ' of approximately 90° with the main panel portions 962, 964, respectively, the assembly 958 defines a maximum overall height H'. The rotatable portions 968, 970, 976, 978 can be further folded along the fold lines 972, 974, 980, 982, respectively, away from the mid-points $M_A$', $M_B$' such that the angles γ' are substantially greater than 90°, thereby forming springs. As such, the assembly 958 can be inserted into a box with a maximum inner height that is less than H', thus maintaining the rotatable portions 968, 970, 976, 978 at angles γ' that are substantially greater than 90°.

Suspension Packaging Frame Member

Figure 23:
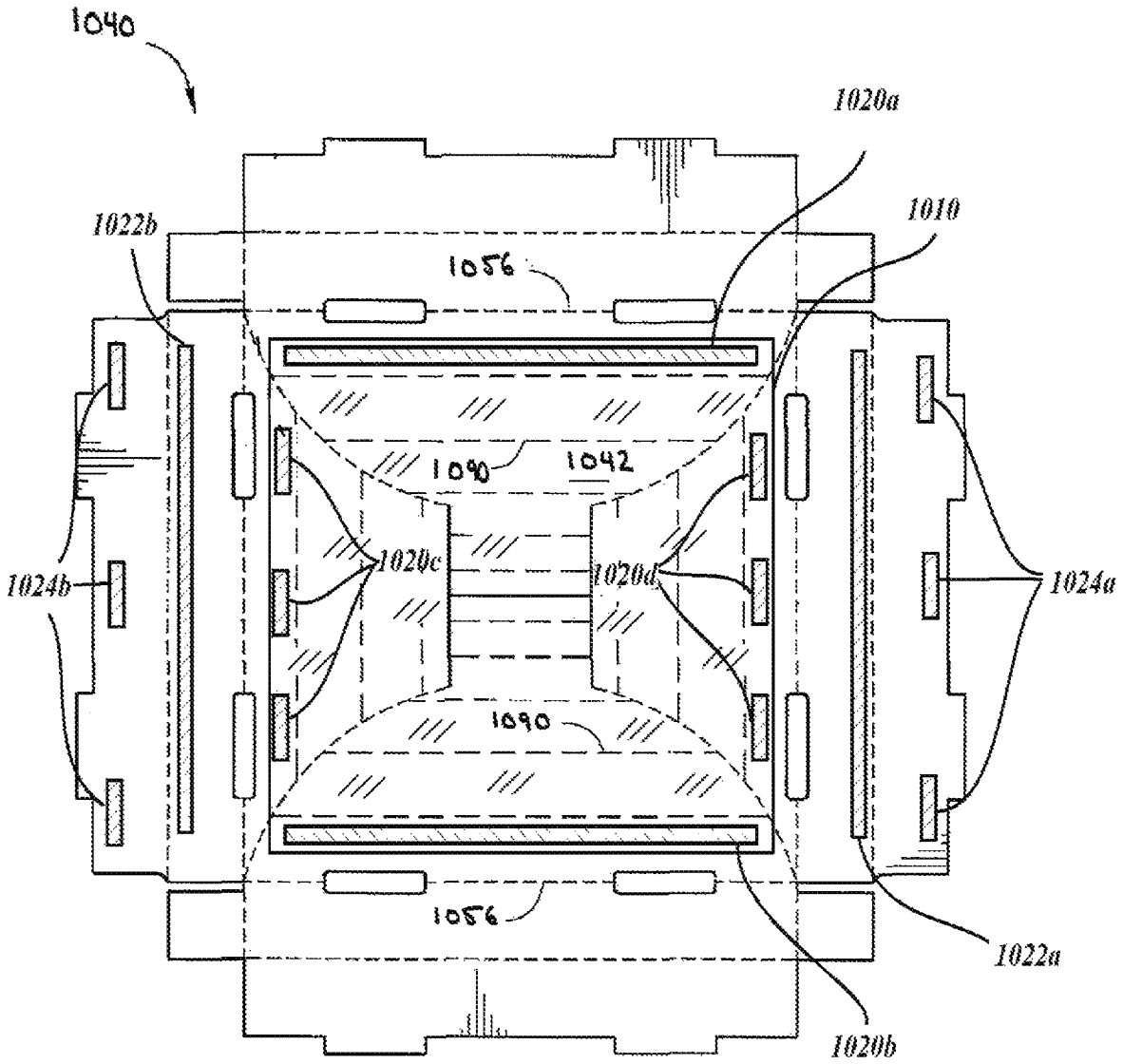
FIG. 23 is a top plan view of another embodiment of a frame member illustrated in an unassembled and unfolded state.
Figure 24:
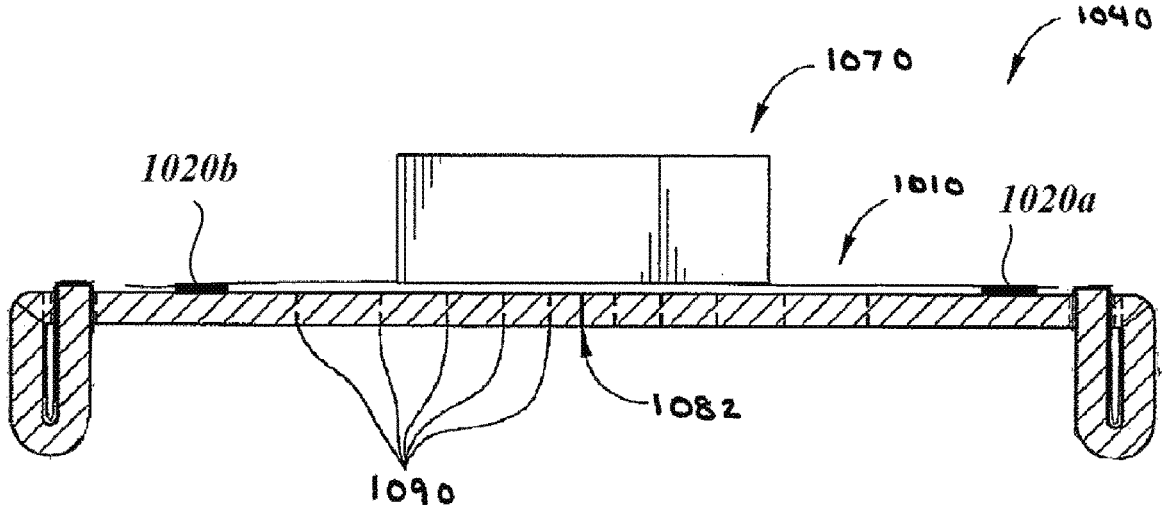
FIG. 24 is an elevational and partial sectional view of the frame member of FIG. 23 connected to a retention member and supporting an article to be packaged.
Figure 25:
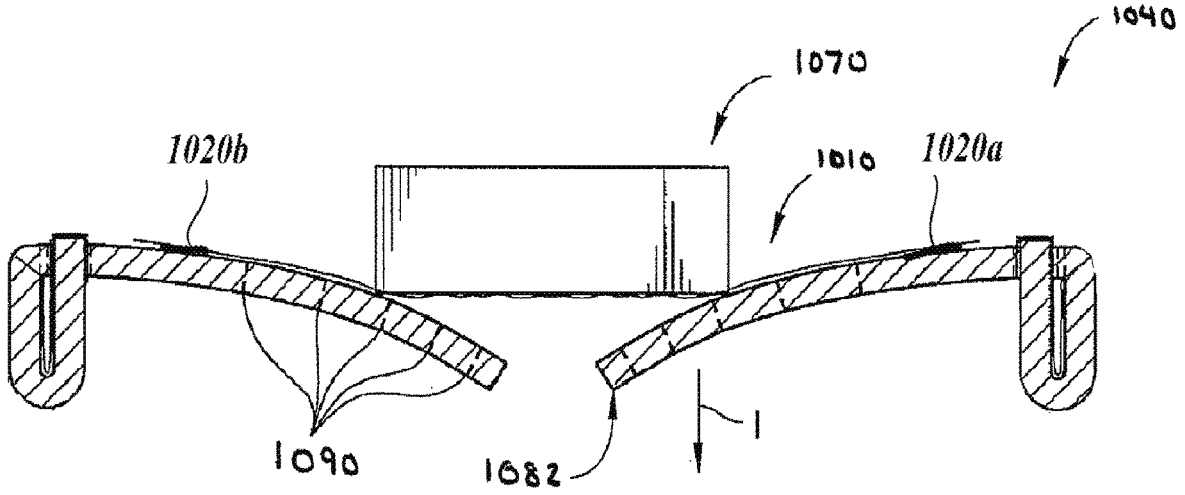
FIG. 25 is an elevational and partial sectional view of the arrangement shown in FIG. 24 and showing a deflected state of the arrangement.

With reference to FIGS. 23-25, a frame member 1040 is illustrated therein and identified generally by the reference numeral 1040. The frame member 1040 shown in FIGS. 23-25 is constructed substantially identically to the tray members 40, 40', and 40" as described in U.S. Pat. No. 7,882,956 which has been entirely incorporated by reference herein except as noted below.

With reference to FIG. 23, the frame member 1040 can also include additional score lines 1090. In the illustrated embodiment, the additional score lines 90 extend generally parallel to the fold lines 1056. Optionally, the score lines 1090 can be arranged generally concentrically around the central area of the base member 1042. The score lines 1090 can be formed in any of the above-noted methods for forming fold lines or score lines, or other methods. A resilient member 1010 is attached to the frame member 1040 via heat seals such as, 1020*a-d*, 1022*a-b*, 1024*a-b*. For example, for use of a smaller resilient member 1010, such as for packaging a smaller article, heat seals 1020*a-d* can be used which are more centrally located. For slightly larger resilient members (not shown), heat seals 1022*a-b* or heat seals 1024*a-b* can be used. Of course, as with the other embodiments of frame members as described herein, other locations for heat seals can also be used.

With reference to FIGS. 24 and 25, when a force I is applied to the article 1070, the score lines 1090 further aid in absorbing the energy created by the force I by allowing the base member 1042 to further bend. Thus, the arrangement, size, and number of cut lines 1082 and score lines 1084, 1090 can be adjusted to provide the desired energy absorption characteristic of the retention member 200*e* and frame member 1040.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method of packaging an article for shipment with a retention packaging assembly, the method comprising:

forming a fibrous corrugated sheet having first and second outer layers formed from a wood-based fibrous material, the first and second outer layers formed around a fluted inner layer;

crushing the fluted inner layer of a first portion of the fibrous corrugated sheet to form a first fold line, the first fold line defining a boundary of a first peripheral portion, the first peripheral portion being pivotable with respect to a central portion about the first fold line;

crushing the fluted inner layer of a second portion of the fibrous corrugated sheet to form a second fold line, the second fold line defining a boundary of a second peripheral portion, the second peripheral portion being pivotable with respect to the central portion and coupled with the central portion opposite the first peripheral portion, the first and second fold lines being substantially parallel;

placing the fibrous corrugated sheet on a conveyor and feeding the fibrous corrugated sheet towards a cutting head and a sealing head;

mounting a roll of thin, single layered, polyethylene film in a manner that provides resistance against turning and feeding an end of the roll towards the sealing head, the thin, single layered, polyethylene film unrolling from the roll as the end is pulled by the conveyor;

overlaying the fibrous corrugated sheet with the thin, single layered, polyethylene film;

reciprocating the cutting head to cut the fibrous corrugated sheet, the fibrous corrugated sheet sized to engage and provide support for an article during storage or shipping;

heating the sealing head to about 850° F.;

actuating the sealing head downwards to apply a pressure of about 10 lb. f/in$^2$ against the thin, single layered, polyethylene film in a direction towards the first outer layer of the first peripheral portion of the fibrous corrugated sheet and compressing the thin, single layered, polyethylene film between the sealing head and the first outer layer;

melting portions of the thin, single layered, polyethylene film into and around fibers of the first outer layer of the fibrous corrugated sheet with the sealing head to form a heat-seal transition area between a first end and a middle segment of the thin, single layered, polyethylene film, the melted portions entangling and mechanically engaging with the fibers of the first outer layer of the fibrous corrugated sheet and thereby securing the thin, single layered, polyethylene film to the fibrous corrugated sheet;

lifting the sealing head after about 0.5 seconds of contact with the first outer layer to form a first heat seal;

forming a second heat seal on the second peripheral portion of the fibrous corrugated sheet, the middle segment of the thin, single layered, polyethylene film extending between the first and second peripheral portions to form the retention packaging assembly;

cooling the first and second heat seals of the retention packaging assembly with a forced convection device;

discharging the retention packaging assembly from the conveyor;

temporarily placing the retention packaging assembly in a container and stacking the heat-sealed packaging assembly with a plurality of retention packaging assemblies;

folding the first and second peripheral portions of the fibrous corrugated sheet about the first and second fold lines, respectively, to provide slack in the thin, single layered, polyethylene film;

lifting the middle segment of the thin, single layered, polyethylene film away from the central portion of the fibrous corrugated sheet;

placing the article against the central portion; and folding the first and second peripheral portions outwardly and downwardly to increase tension in the thin, single layered, polyethylene film and secure the article in place against the central portion;

wherein the heat-seal transition area includes a thickness sufficient to maintain a reliable connection between the first end of the thin, single layered, polyethylene film and the first outer layer of the fibrous corrugated sheet and preventing tearing of the thin, single layered, polyethylene film when subjected to a load during normal use.

2. The method of claim 1, further comprising reciprocating the cutting head to cut the thin, single layered, polyethylene film from the roll.

3. The method of claim 1, further comprising using the sealing head to cut the thin, single layered, polyethylene film from the roll.

4. The method of claim 1, further comprising folding the middle segment of the thin, single layered, polyethylene film between the first and second heat seals to create sufficient slack for allowing the article to be packaged within the retention packaging assembly.

5. The method of claim 1, wherein upon cooling, an interior layer of the first heat seal is located within the first outer layer of the first peripheral portion of the fibrous corrugated sheet and an upper layer of the first heat seal is located above the first outer layer.

6. The method of claim 5, wherein the upper layer is defined by the thickness and extends from the heat seal transition area to an opposite end of the first heat seal.

* * * * *